US008061713B2

(12) United States Patent
Cook

(10) Patent No.: US 8,061,713 B2
(45) Date of Patent: Nov. 22, 2011

(54) THREE DIMENSIONAL GEOMETRIC PUZZLE

(75) Inventor: C. Roger Cook, Greely (CA)

(73) Assignee: TBL Sustainability Group Inc., Manotick, ON (CA)

( * ) Notice: Subject to any disclaimer, the term of this patent is extended or adjusted under 35 U.S.C. 154(b) by 51 days.

(21) Appl. No.: 12/162,261

(22) PCT Filed: Jan. 29, 2007

(86) PCT No.: PCT/CA2007/000115

§ 371 (c)(1),
(2), (4) Date: Jul. 25, 2008

(87) PCT Pub. No.: WO2007/085088

PCT Pub. Date: Aug. 2, 2007

(65) Prior Publication Data

US 2009/0014954 A1 Jan. 15, 2009

Related U.S. Application Data

(60) Provisional application No. 60/762,846, filed on Jan. 30, 2006, provisional application No. 60/745,777, filed on Apr. 27, 2006.

(51) Int. Cl.
*A63F 9/08* (2006.01)

(52) U.S. Cl. ..... 273/157 R; 273/156

(58) Field of Classification Search ..... 273/157 R, 273/156; 434/211

See application file for complete search history.

(56) References Cited

U.S. PATENT DOCUMENTS

| | | | | | |
|---|---|---|---|---|---|
| 1,471,943 | A | * | 10/1923 | Chambers | 273/157 R |
| 2,570,625 | A | * | 10/1951 | Zimmerman et al. | 273/157 R |
| 2,839,841 | A | * | 6/1958 | Berry | 273/157 R |
| 3,184,882 | A | * | 5/1965 | Vega | 446/92 |
| 3,645,535 | A | | 2/1972 | Randolph | |
| 3,655,201 | A | * | 4/1972 | Nichols | 273/153 R |
| 3,659,360 | A | | 5/1972 | Zeischedd | |
| 3,974,611 | A | * | 8/1976 | Satterthwaite | 446/125 |
| 4,210,324 | A | | 7/1980 | Morrison et al. | |
| 4,258,479 | A | | 3/1981 | Roane | |
| 4,334,870 | A | | 6/1982 | Roane | |
| 4,334,871 | A | | 6/1982 | Roane | |
| 4,529,201 | A | | 7/1985 | Nadel | |
| 4,676,507 | A | | 6/1987 | Patterson | |
| 4,790,759 | A | * | 12/1988 | Mosseri et al. | 434/211 |
| 5,009,625 | A | | 4/1991 | Longuet-Higgins | |
| 5,127,652 | A | | 7/1992 | Unger | |

(Continued)

OTHER PUBLICATIONS

A and B Quanta Modules, pp. 501 to 510.

(Continued)

*Primary Examiner* — Steven Wong
(74) *Attorney, Agent, or Firm* — Marks & Clerk

(57) ABSTRACT

Disclosed is a geometric puzzle comprising a plurality of three-dimensional components of at least one type, each component of the same type being derived by notionally dividing a fundamental shape into a plurality of equal parts, said fundamental shape being selected from the group consisting of a regular tetrahedron having edges of equal length and a regular pyramid with a square base and also having edges of equal length, said components being capable of assembly into multiple composite shapes. Each component may be equal and identical to one another or each pair of components may comprise mirror images of one another. Surfaces of said components may be provided attractive magnetic elements to hold said components in a composite shape.

8 Claims, 25 Drawing Sheets

U.S. PATENT DOCUMENTS

| | | | | |
|---|---|---|---|---|
| 5,249,966 | A * | 10/1993 | Hiigli | 434/211 |
| 5,338,034 | A | 8/1994 | Asch | |
| 5,660,387 | A | 8/1997 | Stokes | |
| 6,116,979 | A * | 9/2000 | Weber | 273/157 R |
| 6,158,740 | A | 12/2000 | Hall | |
| 6,257,574 | B1 | 7/2001 | Evans | |
| 6,439,571 | B1 * | 8/2002 | Wilson | 273/157 R |
| 7,413,493 | B2 * | 8/2008 | Toht et al. | 273/156 |
| 2003/0234488 | A1 | 12/2003 | Povitz | |
| 2005/0014112 | A1 | 1/2005 | Fentress | |

OTHER PUBLICATIONS

"Exploration in Geometry of Thinking Synergetics", R. Buckminster Fuller, Macmillan Publishing Co., Inc., New York, 1975, p. 502-507.

* cited by examiner

THREE DIMENSIONAL GEOMETRIC PUZZLE

CROSS-REFERENCE TO RELATED APPLICATION

This application claims the benefit under 35 USC 119(e) of U.S. Provisional Applications No. 60/762,846 filed Jan. 30, 2006, and 60/745,777 filed Apr. 27, 2006, both of which are incorporated by reference herein.

FIELD OF THE INVENTION

The present invention relates to the field of puzzles and toys, and more specifically, the present invention relates to a hand-manipulated three dimensional puzzle comprising a group of individual polyhedrons which can be assembled together in different ways to form solid geometric or composite shapes.

BACKGROUND OF THE INVENTION

Geometric puzzles, both two dimensional and three dimensional, are known in the art. Many of these puzzles are of the type that comprises individual parts which can be assembled and reassembled to form various shaped objects.

However, there is always a need for a new puzzle to challenge puzzle solvers, especially a puzzle that requires manual dexterity and educational skill. Such a puzzle can be useful to both adults and children alike, providing a challenge for an adult and an educational opportunity for a child. Many prior art puzzles are limited in the number of solutions possible and thus are quickly exhausted.

SUMMARY OF THE INVENTION

Disclosed is a hand-manipulated three dimensional building block system comprising a set or group of individual tetrahedron components which may be assembled and reassembled into various solid geometric or composite shapes. In one embodiment, each set has twenty four components capable of assembly into a regular cube. Each set is also capable of assembly as a twelve component square-based pyramid and a twelve component regular tetrahedron. Various other geometric solids may be formed from the components. The tetrahedron, the simplest polygonal solid, is of special interest, in that all other polygonal solid figures can be broken down into tetrahedrons. In this manner, a number of shapes can be produced by assembling tetrahedrons of various shapes.

Each set comprises at least one of two basic tetrahedral components, each of a basic shape. The first basic shape or "T" component is a tetrahedron equivalent to one twelfth of a regular tetrahedron (all 6 edges of equal length, all four faces equilateral triangles). The second basic shape or "P" component is also a tetrahedron, but of a different shape. The "P" component is equivalent to one twelfth of a regular square based pyramid (4 triangular faces each an equilateral triangle). The edges of the tetrahedron from which the "T" piece is constructed are the same length as the edges of the pyramid from which the "P" piece is constructed. The consequence of this is that one of the faces of the "T" piece has exactly the same dimensions as one of the faces of the "P" piece.

Each tetrahedron component is preferably hollow, with magnets placed within each component with such polarity that upon proper assembly of the components, the magnets of facing faces attract each other and help hold the blocks together. Magnets imbedded in the surface of each of the faces of the "P" and "T" tetrahedral components enable them to stick together to hold their combined shape. In another embodiment, each tetrahedral component can also be solid with magnets inserted into recesses located in the surface of each face.

In one preferred embodiment of the invention, color relationships are provided in order to help in assembly. Each face of each tetrahedron component is a different color—for example, the colors red, blue, green and yellow can be used. However, to make the puzzle more challenging, the color relationship may be avoided.

These "P" and "T" components have astounding versatility such that tetrahedral, pyramidal, cubic, rectagonal, pentagonal, hexagonal, octagonal, rhombohedral and icosahedral structures can be created. All 7 unique crystal systems (cubic, hexagonal, tetragonal, rhombohedral (also known as trigonal), orthorhombic, monoclinic and triclinic) can be described with combinations of these "P" and "T" components.

Combining together multiple systems increases the number of these "T" and "P" components and presents a challenge to the user to manipulate the components to form regular, recognizable, familiar shapes from these unfamiliar, irregularly shaped tetrahedra. The greater the number of total components used, the greater the diversity of shapes that can be built and the greater the interest and challenge.

Accordingly, in one aspect, the invention provides a geometric puzzle comprising a plurality of three-dimensional components of at least one type, each component of the same type being derived by notionally dividing a fundamental shape into a plurality of equal parts, said fundamental shape being selected from the group consisting of a regular tetrahedron having edges of equal length and a regular pyramid with a square base and also having edges of equal length, said components being capable of assembly into multiple composite shapes.

Each component may be equal and identical to one another, or each pair of components may comprise mirror images of one another.

The puzzle may comprise two said types, a first of said types having components derived from said regular tetrahedron and a second of said types being derived from said pyramid.

The triangular face of said regular tetrahedron is divided into three equal parts forming isosceles triangles meeting a central point in the surface. The triangular faces of said regular pyramid is also divided into three equal parts forming isosceles triangles meeting at a central point on the surface. The square pyramid base is divided into 4 equal parts forming isosceles triangles meeting at a central point on the surface.

Surfaces of said components are provided attractive magnetic elements to hold said components in a composite shape.

When used either for play or education, the invention provides numerous opportunities for assembling various shapes from the tetrahedrons. The building block system can be educational and entertaining for all ages. With a set of tetrahedrons in accordance with this invention, a puzzle solver may learn about geometric and physical relationships, such as learning to visualize spatial relationships.

Embodiments of the invention teach principles of solid geometry and spatial relationships and improving manual dexterity through a challenging and amusing puzzle to solve.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein:

FIG. 13 also shows the flat plan views that illustrate the location of the magnets of the left and right half "T" components according to one embodiment;

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

Disclosed is a building block system comprising a plurality of three-dimensional components of at least one type. Each component of the same type has the same shape and is derived by notionally dividing a fundamental shape into a plurality of equal parts, said fundamental shape being selected from the group consisting of a regular tetrahedron having edges of equal length and a pyramid with a square base and having edges of equal length. The length of the edges of the said tetrahedron and the edges of the said pyramid are the same.

In one embodiment, there are two types of components. Referring to FIGS. 1*a*,2*a* and FIGS. 3 to 8, these tetrahedron components are designated the "P" tetrahedron and the "T" tetrahedron. The triangular face of said regular tetrahedron is divided into three equal parts forming isosceles triangles meeting a central point in the surface to form the T component. The triangular face of said regular pyramid is divided into three equal parts forming isosceles triangles meeting at a central point in the surface and the pyramid base is divided into 4 equal parts forming isosceles triangles meeting at a central point on the surface to form the P component.

Figure 1A:
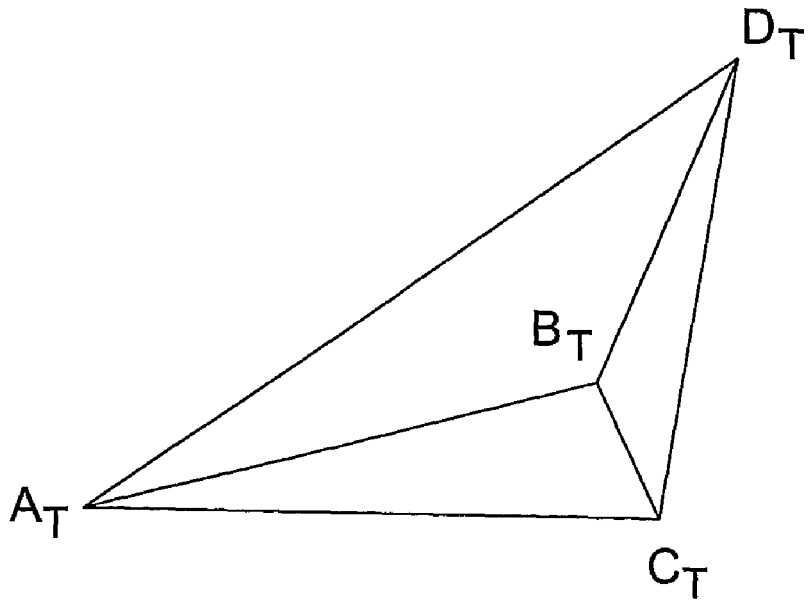
FIGS. 1*a* and 2*a* illustrate the T and P components, respectively, used in one embodiment of the building block system contemplated by the present invention.
Figure 2A:
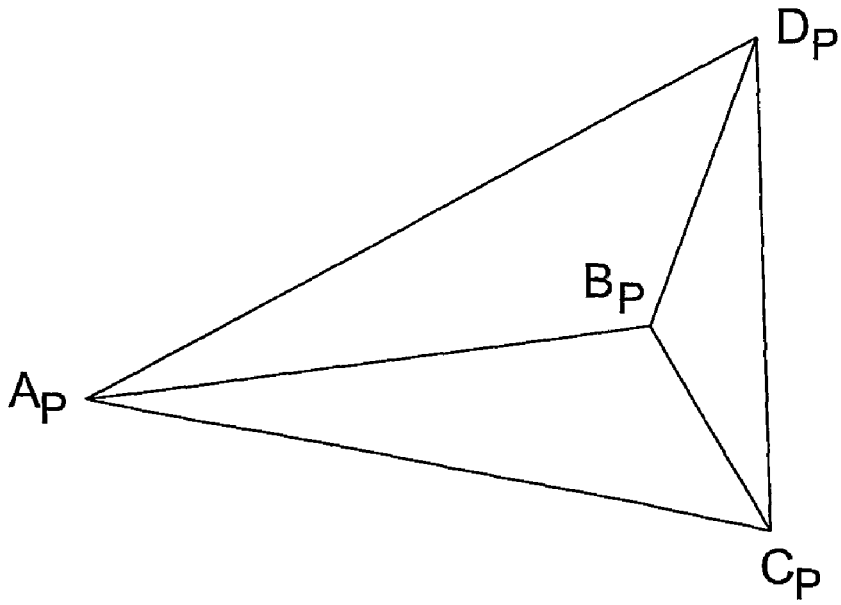
Figure 2B:
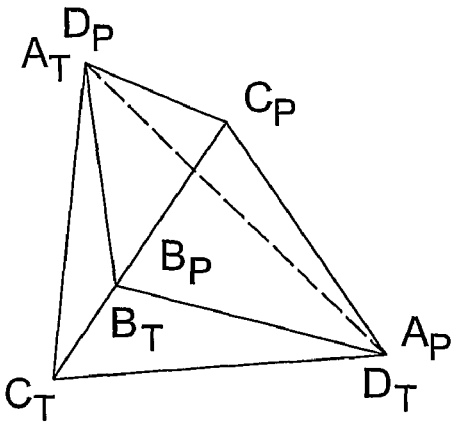
FIG. 2*b* represents a "P" and a "T" component joined together to make a "PT" component.
Figure 2C:
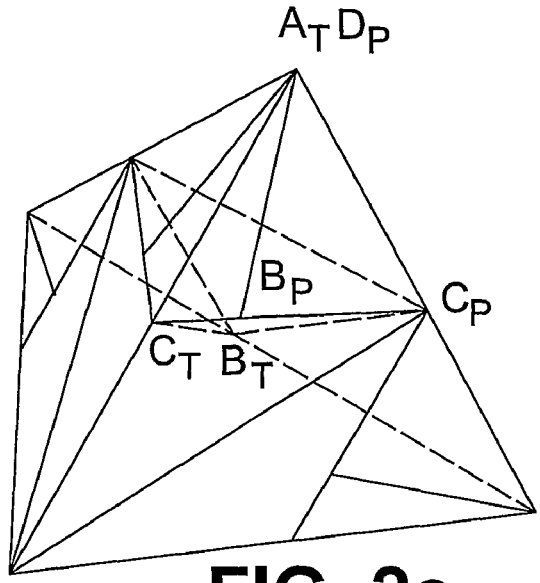
FIG. 2*c* represents eight P and eight T components joined together to form a double size PT component.
Figure 2D:
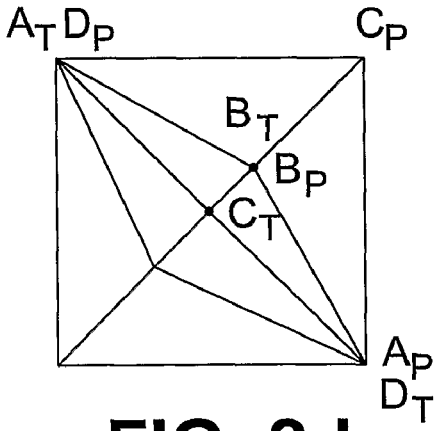
FIG. 2*d* represents 2 "P" and 2 "T" components joined together to make a square based pyramid.
Figure 2E:
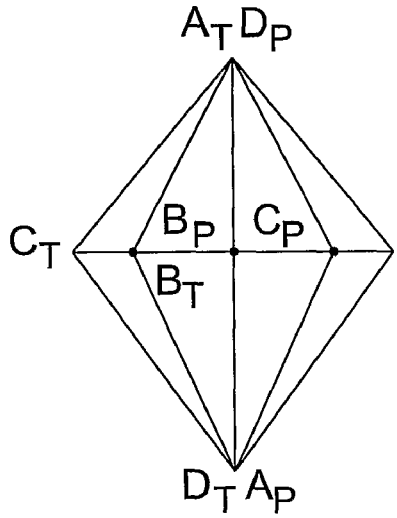
FIG. 2*e*, represents 2 "P" and 2 "T" components joined together to make a rhombic based pyramid.

These two tetrahedrons have special properties in that they can be put together to form a surprising variety of regular and irregular geometric shapes, as is described below. One of the faces of the "T" component is identical to one of the faces of the "P" component. This is the one face that enables "T" and "P" components to match together. When these two "T" and "P" components are joined together with the identical faces touching and precisely overlapping the resultant shape is a "PT" component, seen in FIG. 2*c*. This combined component is a "space packer". When multiple numbers of space packer shaped components are joined face to face in each direction they do not leave space between them. An infinite number would pack space completely without leaving any void space between the components. A cube is one example of a space packer. The "P" unit on its own and in combination with only other "P" units is not a space packer. Neither is the "T" unit on its own and in combination only with other "T" units a space packer. The space packing property only comes when P and T units are used in combination.

Each of the T and P components has sides and angles that are in geometric relation to one another. The following tables list those relationships.

| T component edge lengths (refer to FIG. 4) | |
|---|---|
| $A_TD_T$ | X |
| $A_TB_T$ | $x/\sqrt{3}$ |
| $A_TC_T$ | $(x\sqrt{3})/(2\sqrt{2})$ |
| $B_TC_T$ | $x/(2\sqrt{6})$ |
| $B_TD_T$ | $x/\sqrt{3}$ |
| $C_TD_T$ | $(x\sqrt{3})/(2\sqrt{2})$ |
| T component angles (refer to FIG. 4) | |
| $C_TA_TD_T$ | 35° 16' |
| $A_TC_TD_T$ | 109° 28' |
| $C_TD_TA_T$ | 35° 16' |
| $B_TA_TD_T$ | 30° |
| $A_TD_TB_T$ | 30° |
| $D_TB_TA_T$ | 120° |
| $C_TA_TB_T$ | 19° 28' |
| $A_TB_TC_T$ | 90° |
| $B_TC_TA_T$ | 70° 32' |
| $C_TD_TB_T$ | 19° 28' |
| $D_TB_TC_T$ | 90° |
| $B_TC_TD_T$ | 70° 32' |
| P component edge lengths (refer to FIG. 3) | |
| $A_PD_P$ | X |
| $A_PB_P$ | $x/\sqrt{3}$ |
| $A_PC_P$ | $x\sqrt{2}$ |
| $B_PC_P$ | $x/\sqrt{6}$ |
| $B_PD_P$ | $x/\sqrt{3}$ |
| $C_PD_P$ | $x\sqrt{2}$ |
| P component angles (refer to FIG. 3) | |
| $C_PA_PD_P$ | 45° |
| $A_PC_PD_P$ | 90° |
| $C_PD_PA_P$ | 45° |
| $B_PA_PD_P$ | 30° |
| $A_PD_PB_P$ | 30° |
| $D_PB_PA_P$ | 120° |
| $C_PA_PB_P$ | 35° 16' |
| $A_PB_PC_P$ | 90° |
| $B_PC_PA_P$ | 54° 44' |
| $C_PD_PB_P$ | 35° 16' |
| $D_PB_PC_P$ | 90° |
| $B_PC_PD_P$ | 54° 44' |

In a preferred embodiment, x equals 10 cm. But it will be understood by one normally skilled in the art that x could be any suitable length.

Each group of components can be assembled into kits to form a building block system. There are several kits that these systems can be packaged in. A preferred kit comprises one building block system which has twenty four components comprising twelve of each of the two basic tetrahedral components capable of assembly into a regular cube. In other words, the kit is composed of 12 "T" components and 12 "P" components. There are several different solutions to the puzzle at this level. One challenge is to build a cube (relatively easy) another is to build a regular hexagonal shape (FIG. 17) with a hexagon top and bottom and vertical sides (relatively difficult). This kit also enables the construction of the PT piece and the double size PT piece, 2 rhombic hexahedrons, a regular tetrahedron, a regular pyramid, the isosceles octahedron, a rhombic based pyramid (all edges the same length) and other regular and irregular shapes that mathematicians have not given names. This is further described below.

Figure 21:
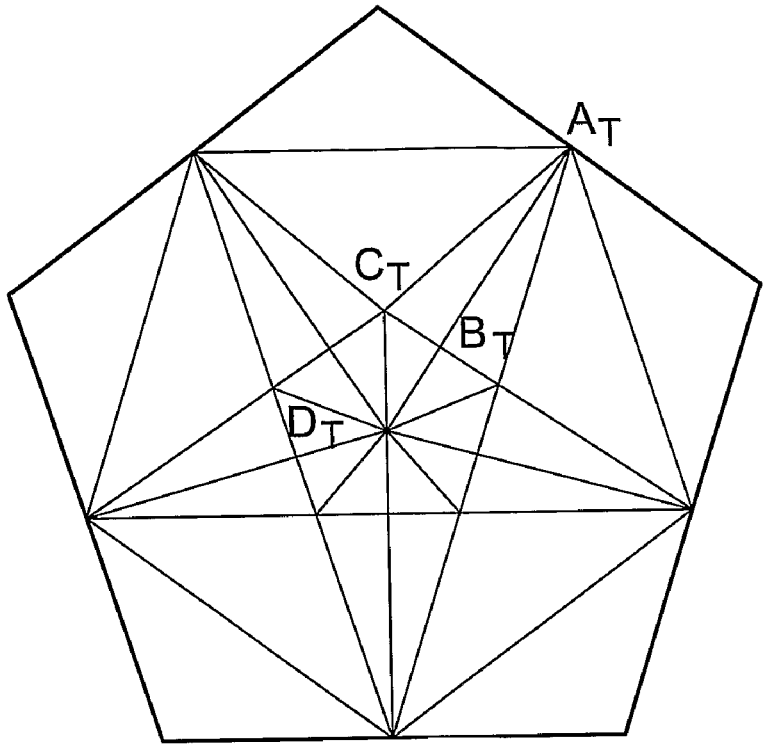
FIGS. 21 and 22 show the top and bottom views of the Pentagram made from 30 "T" units and 30 "P" components.
Figure 22:
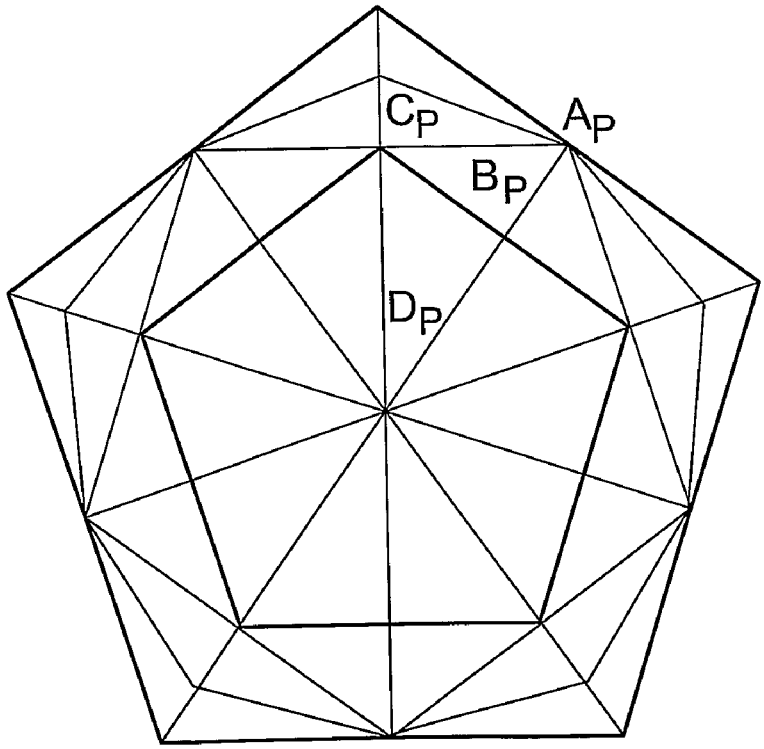

A "level 2 kit" is comprised of three systems (36 "T" components and 36 "P" components). One of the challenges for the user is to assemble the units into the shape of a pentagram (FIGS. 21 and 22). The pentagram has regular pentagonal faces top and bottom, sloping sides and a pentagonal star in the centre of the larger of the pentagonal face. This "level 2 kit" also provides a sufficient number of "P" and "T" pieces to enable construction of all the shapes described in the "level 1 kit" plus an additional two cubes, two forms of the rhombic dodecahedron (FIGS. 23 and 24), the regular octahedron (FIG. 15*a*), the double size isosceles octahedron, hexagonal combinations, Rectangular box (FIG. 18) and many other regular and irregular shapes and polygons that mathematicians have not given names.

The "level 3 kit" is comprised of 6 systems (72 "P" components and 72 "T" components.) This enables construction of all the shapes possible with "level 1 kit" and "level 2 kit", and enables the construction of 6 cubes, a double size regular tetrahedron (FIG. 19), the double size regular pyramid (FIG. 20), the pentagon (vertical sides and identical penatogons and pentagonal stars top and bottom), and many other regular and irregular shapes that mathematicians have not given names.

Figure 35:
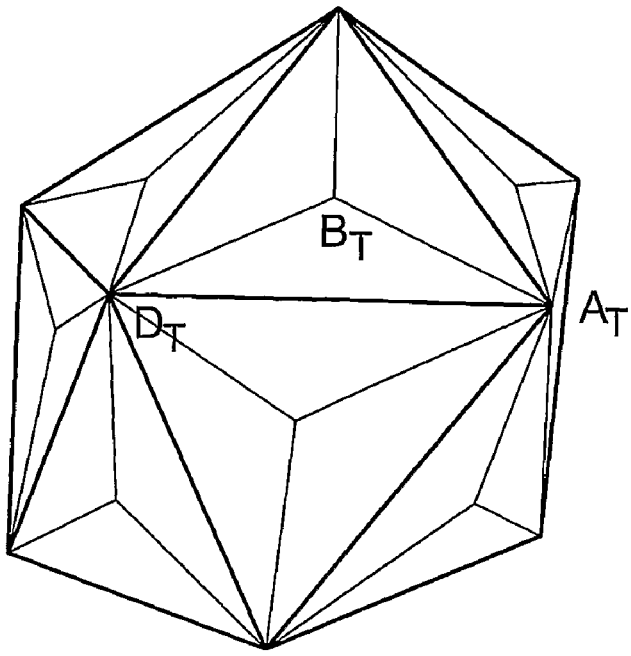
FIG. 35 illustrates the icosahedron formed by 240 "T" components. The icosahedral shell formed by 120 "T" components looks identical, but has "T" components missing from the interior of the structure.
Figure 36:
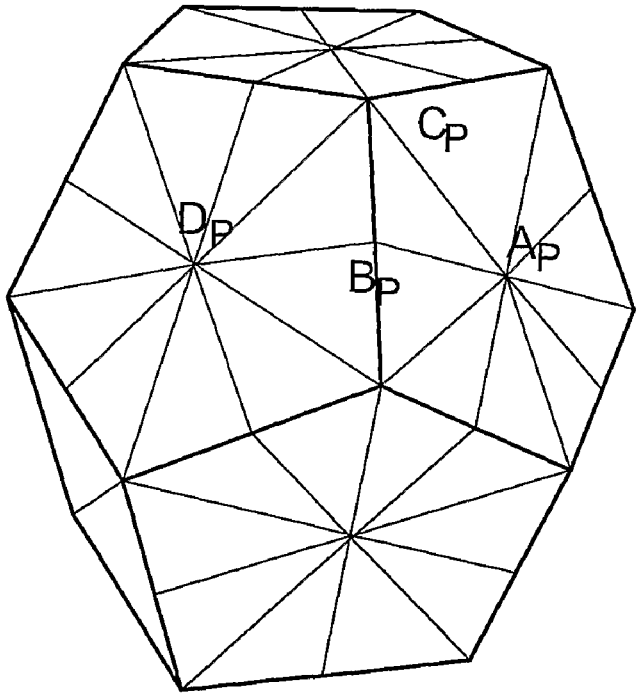
FIG. 36 illustrates the pentagonal dodecahedron which is made from 120 "T" components and 120 "P" components.

The "level 4 kit" is composed of 10 systems (120 "P" components and 120"T" components). This enables the construction of all the shapes possible with the level 1 kit, the level 2 kit and the level 3 kit and enables the construction of 10 cubes, a cuboctahedron, an icosahedral shell (see FIG. 35) and ultimately the pentagonal dodecahedron (see FIG. 36). The pentagonal dodecahedron is a regular shape with 12 faces each a regular pentagon—all edges the same length). The conversion of the 120 "P" components and 120"T" components into the pentagonal dodecahedron is considered the ultimate solution to the "level 4 kit" puzzle.

Figure 7:
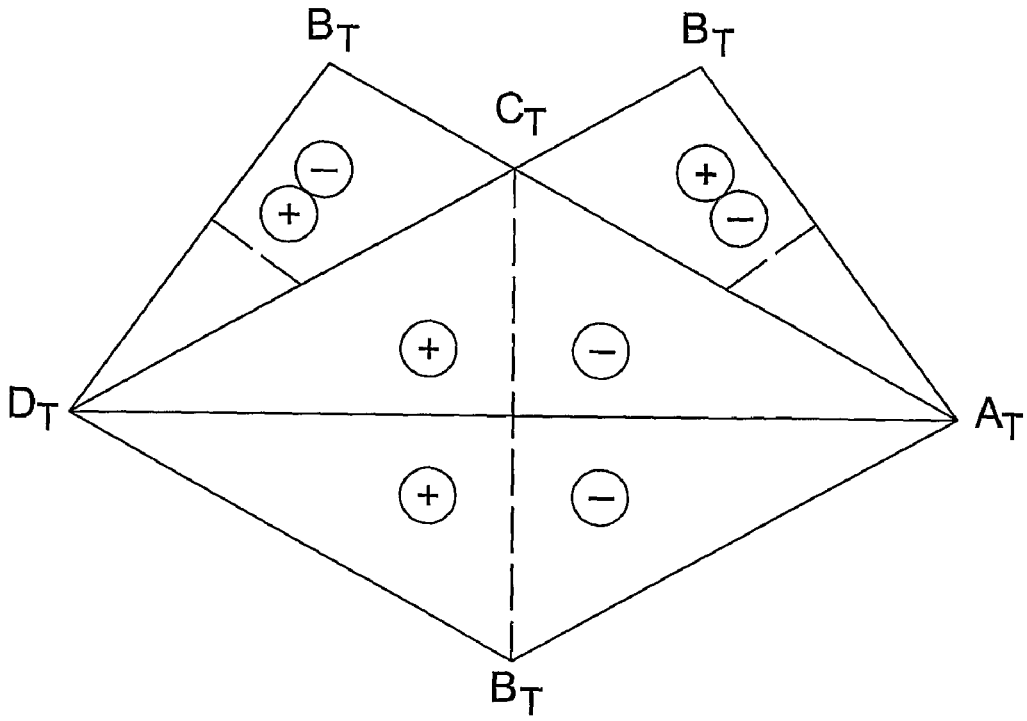
FIGS. 7 and 8 are flat plan views that illustrate the location of the magnets inside the T and P components, respectively, according to one embodiment.
Figure 8:
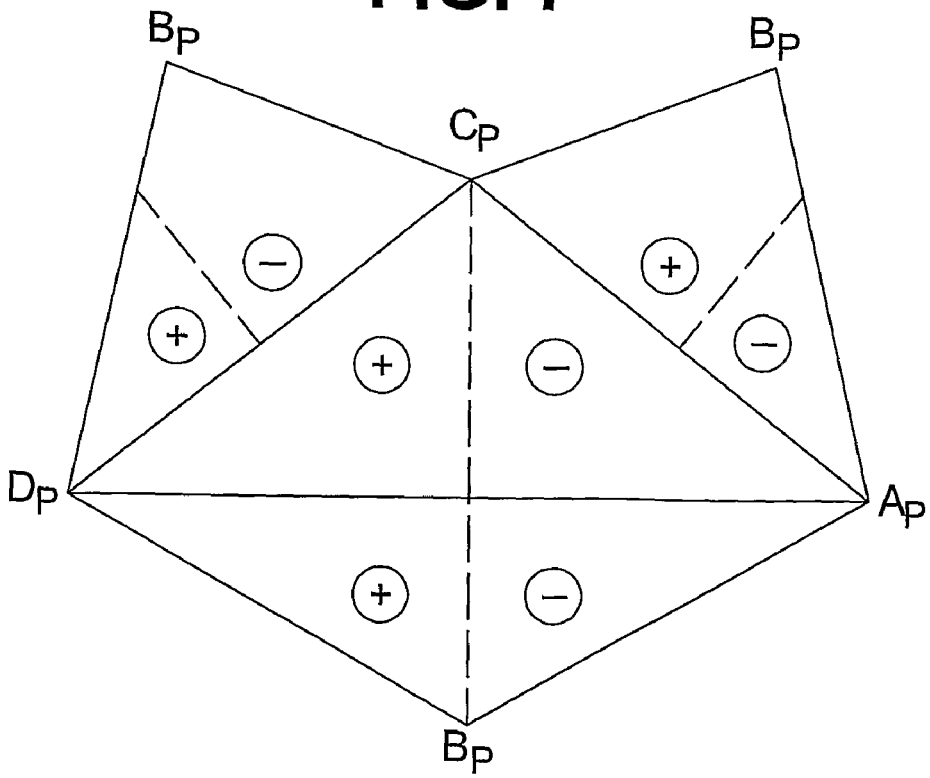
Figure 9:
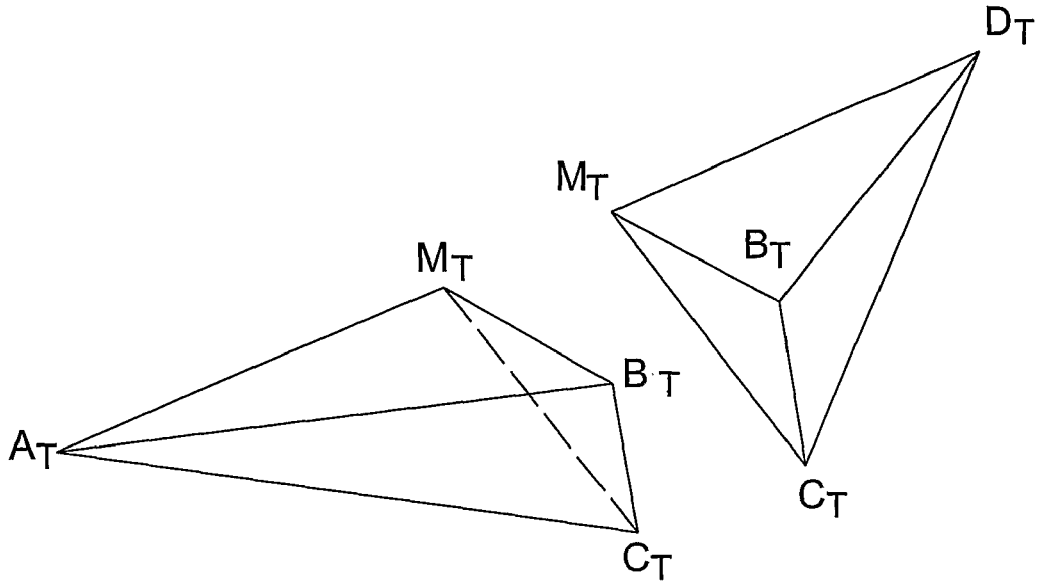
FIG. 9 illustrate the left and right half T component respectively.
Figure 10:
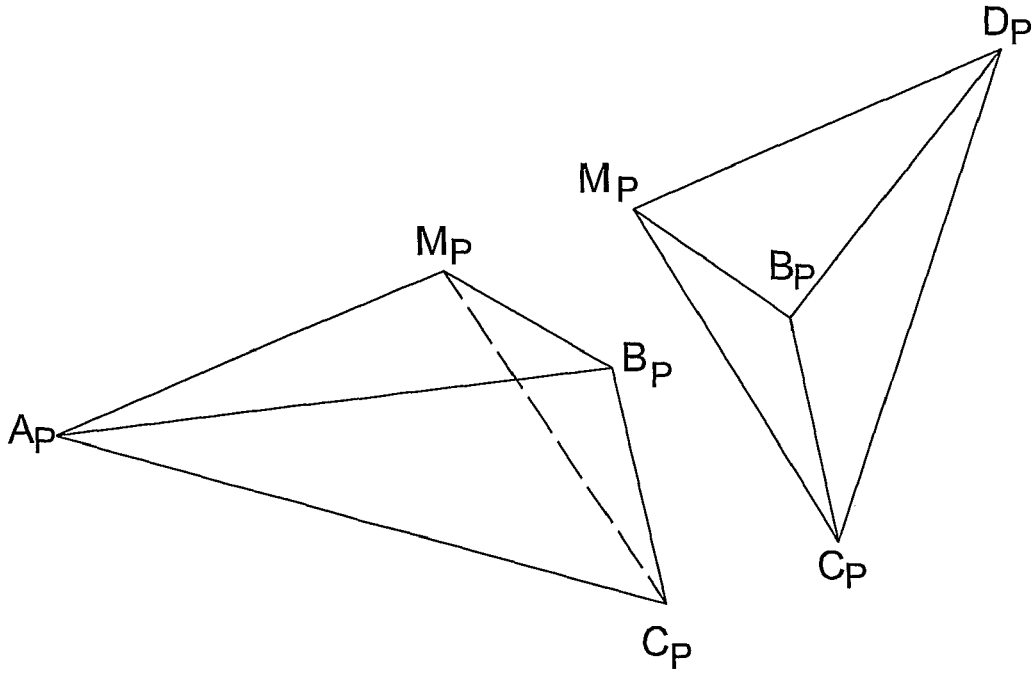
FIG. 10 illustrate the left and right half P component respectively.
Figures 11A, 11B:
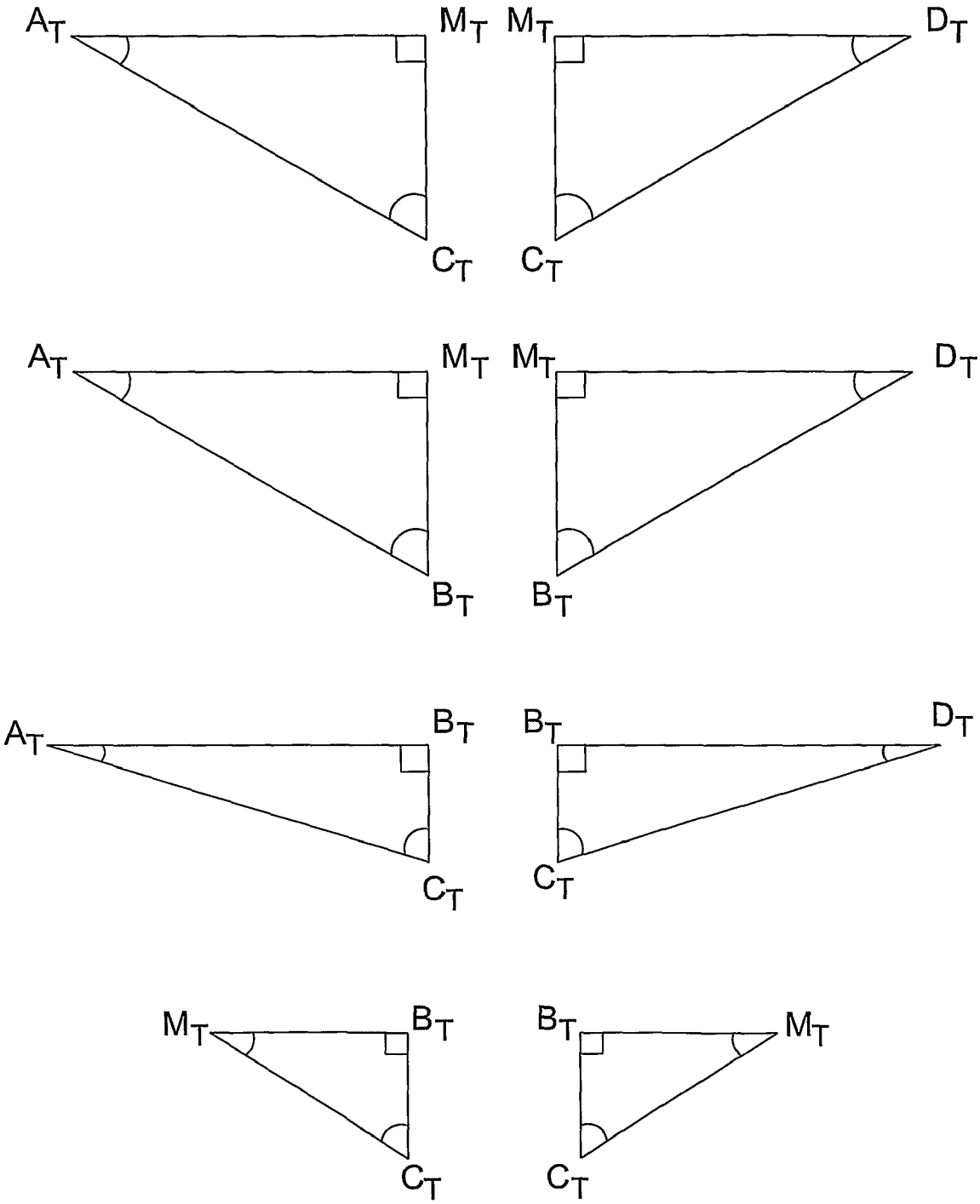
FIGS. 11*a* and 11*b* show the triangles that make up the left and the right half "T" components.
Figure 12A:
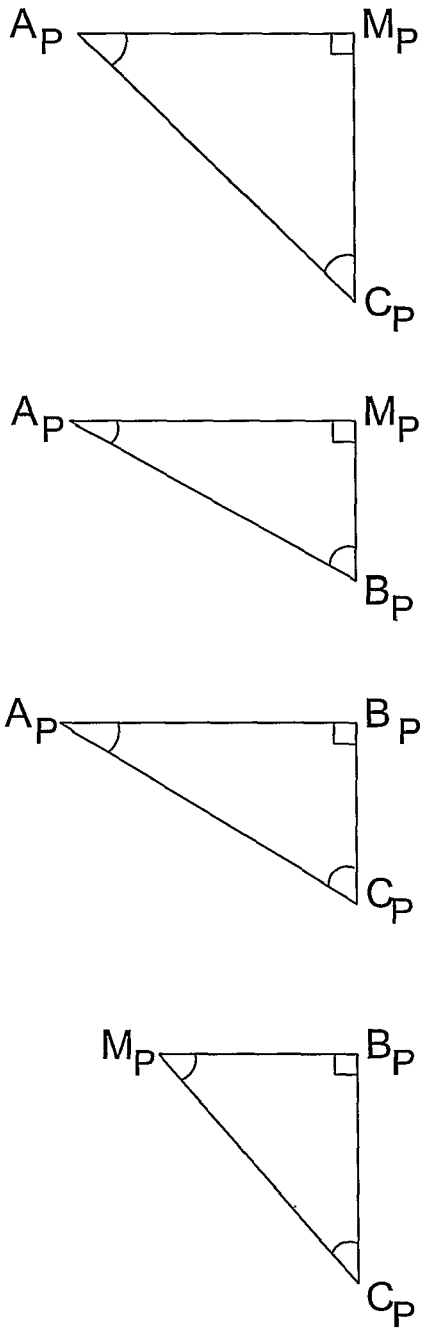
FIGS. 12*a* and 12*b* show the triangles that make up the left and right half "P" components.
Figure 12B:
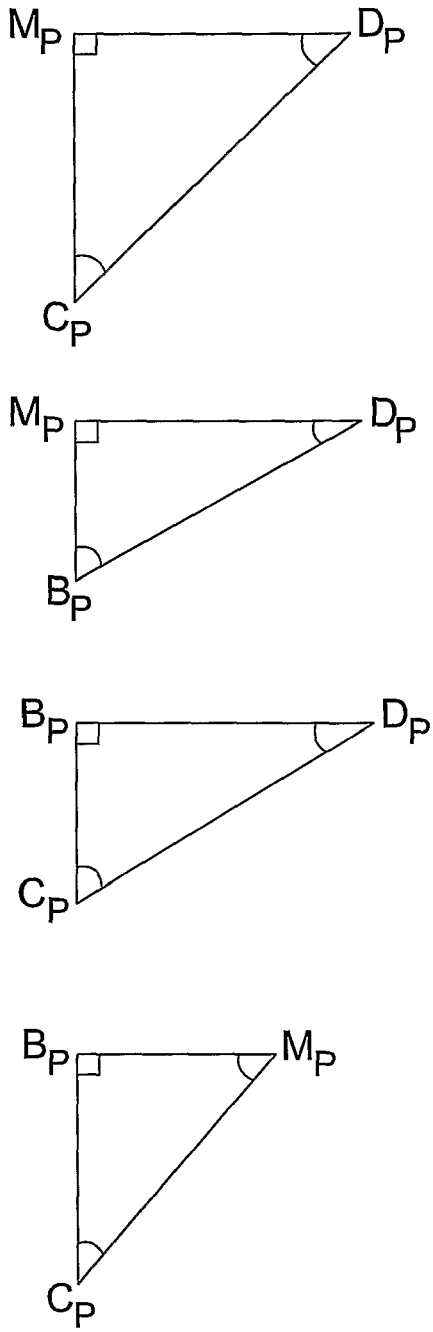

Referring to FIGS. 7 and 8, the two tetrahedrons have been designed with magnets embedded within each of their faces in order to permit the components to be temporarily and releasably joined together to form the composite shapes. The magnets are embedded into the surface of each of the faces of the "T" and "P" components such that faces of the "T" components are attracted to the corresponding, identical matching faces of other "T" components. Similarly, the faces of the "P" components are attracted to the corresponding, identical, matching faces of other "P" components. One of the faces of the T component matches precisely one of the faces of the P component. The placement of magnets in these particular faces of the T and P piece are identical to ensure the P and T pieces can be joined by this face.

The magnets are of sufficient strength to resist falling apart, but they can be manually pulled apart to permit assembly and reassembly of the components into various composite shapes. Because of this magnetic nature, the matrix is only limited by the number of tetrahedral components available to the individual using the system. If an infinite number of basic components are available, the system is infinitely expandable. All kits described above are compatible because all the "P" and "T" units they contain are identical.

This invention contemplates the use of both polar magnets, bar magnets and strip magnets. Polar magnets are magnets with a positive pole on one side and a negative pole on the opposite side. Metal or ceramic disc magnets are suitable as an example, but any material and suitable strength of magnet would suffice. The choice of location for the magnets is based upon two criteria: 1) the placement must accomplish the main objective of attracting an identical object to itself, and 2) the placement must consider the other magnets within the structure so there is no interference within the structure or with the outside perimeter of the object. The magnets also must not protrude from the surface of the object.

With these two criteria in mind, the magnets are best placed such that they are equidistant from a line of symmetry drawn through the objects to be joined. In the instance of the tetrahedral "P" component and the "T" component, each have two faces that are isosceles triangles and two faces that are right angled triangles, the line of symmetry chosen for the isosceles triangles is a line drawn from the vertex of the triangle (where the sides that are of equal length meet) to the mid point of the longest side of the isosceles triangle. This line cuts the longest side at right angles. This line is important because when the triangle is rotated 180 using this line as an axis, the rotated triangle fits exactly over the top of the stationary triangle.

With respect to magnet placement in the faces in the shape of isosceles triangles, a positive pole magnet is placed a suitable vertical distance from the base edge of the triangle and a suitable horizontal distance to the right of the vertical line of symmetry described. A negative pole magnet is placed an identical vertical distance from the base edge of the triangle as the positive pole magnet and identical distance to the left of the vertical line of symmetry. If this is done as described to two isosceles triangles such that they look identical, when one of the triangles is rotated 180 and placed over the top of the other triangle the two magnets precisely overlap and the poles are opposite therefore causing the attraction and joining of the two triangles.

With respect to magnet placement in the faces that have the shape of right angled triangles, it should be noted at the outset that the location of the magnets in the faces of the "P" component and the "T" component are such that they permit a special bonding property of the tetrahedrons that is difficult to discover and therefore makes the puzzle that much more difficult to solve. Without this arrangement the single cube cannot be converted to a hexagon because there would be repulsion amongst the magnetic poles prohibiting the necessary bonding.

The line of symmetry for the right angled triangles of the "P" component is obtained by drawing a line at 90 degrees from the mid point of the hypotenuse until it meets the opposite side of the triangle. Magnets with opposite poles are placed on opposite sides of this line such that when the triangle is rotated about this line the two magnets precisely overlap. Note also that the poles of the magnets in these two triangles is opposite to each other. This permits bonding between components to occur.

The two right angled triangles on the faces of the "T" component have magnets with opposite poles as shown in the diagram. They are located away from the largest angle of the triangular face and an identical distance from the line of symmetry. The line of symmetry chosen for this application is a line drawn at 90 degrees through the mid point of the second longest side to the point where it touches the opposite side of the triangle. The poles are opposite for the toy to function.

Figure 2F:
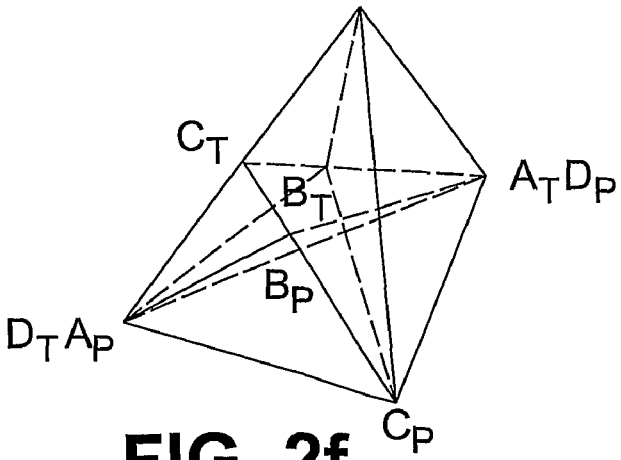
FIG. 2*f* represents 2 "P" and 2 "T" components joined to make a tetrahedron.

The arrangement of the magnets in the right angled triangle faces of the "P" and the "T" components allows two "PT" components to join to form a tetrahedron as depicted in FIG. 2*f*. This bonding arrangement is a critical factor in increasing the toy's interest and versatility. It is not obvious for the player to discover this mode of combining the P and T units and therefore adds challenge to the puzzle.

In another embodiment, the invention may use plastic strip magnets instead. Strip magnets used have a positive edge and a negative edge. The strip preferably used in this application is ½ inch wide strip. This width of strip magnet is chosen simply for convenience and the scale of tetrahedrons being used. The ½ inch magnetic strip tape is also the most readily available in hardware stores. Any strip magnet could be used as long as it is sufficiently strongly magnetic and provided the alignment of the poles of the magnets within the plastic is consistent. Use of a magnetic strip that is not of consistent structure would produce repulsion instead of attraction and the system would not work.

In another embodiment, the invention may use a bar magnets with a positive and a negative end. The single bar magnet in each face replaces two metal or ceramic disc magnets in each face.

Just as with the pole magnets, the two criteria for locating the magnets are: 1) the selection of a line of symmetry, and 2) to avoid placing the magnets too close to the edge of the object while avoiding conflicts between the magnets inside the objects. The magnets do have a certain thickness and this must be respected to ensure a proper fit of the magnets inside the object (or in this particular example—in the tetrahedrons).

Preferably, all the magnets in the case of the strip magnets are ¼ inch×½ inch. These strip magnets are set side by side in pairs with alternating poles. Note that even if these magnets are rotated 180 degrees the location of the poles is not altered. This means that the strip magnets cannot be installed upside down. The poles are the same no matter which way up they are installed. (It is obvious that they must not be installed sideways.) Only the "T" component has individual magnets ¼×½ inch on the two right angled faces and this is because the space within the right angled face in this tetrahedron is limited.

The building block system in accordance with the teachings of this invention is such that mass produced components can be joined together. The magnets are placed in such a way that the identical components do not repel each other, but attract each other. The components remain joined until they are pulled apart. The strength of the magnets used is such that the components can be easily pulled apart by hand, but the components will not just fall apart when tapped.

While embodiments of the invention have been described with the specific use of magnets to join the various components together, it will be fully appreciated by one normally skilled in the art that any suitable fastener can be used. For instance, the fasteners could be Velcro® or an arrangement of mating nipples and recesses for example.

Referring to FIGS. 9, 10, 11, and 12 although this invention has been described using two components, namely the T and P components, the invention also contemplates the use of ½ P and ½ T components (P=left ½P+right ½ P; T=left ½ T+right ½ T). That is each T and P component can be divided in half along its line of symmetry. Each half component is a mirror image of the other. In other words, they are right and left hand versions. These half components exhibit chirality and they are enantiomorphs.

The length of the sides and the angles of the faces of the half "P" and Half "T" pieces are described in the following tables

| Left half "T" Component edge lengths (refer to FIG. 9) | |
|---|---|
| $A_TM_T$ | x/2 |
| $A_TB_T$ | $x/\sqrt{3}$ |
| $A_TC_T$ | $x\sqrt{3}/2\sqrt{2}$ |
| $B_TC_T$ | $x/\sqrt{6}$ |
| $M_TC_T$ | $x/2\sqrt{2}$ |
| $M_TB_T$ | $x/2\sqrt{3}$ |
| Right Half "T" component edge Lengths (refer to FIG. 9) | |
| MTDT | x/2 |
| BTDT | $x/\sqrt{3}$ |
| CTDT | $x\sqrt{3}/2\sqrt{2}$ |
| BTCT | $x/2\sqrt{6}$ |
| MTCT | $x/2\sqrt{2}$ |
| MTBT | $x/2\sqrt{3}$ |
| Left half "P" Component edge lengths (refer to FIG. 10) | |
| $A_PM_P$ | x/2 |
| $A_PB_P$ | $x/\sqrt{3}$ |
| $A_PC_P$ | $x/\sqrt{2}$ |
| $B_PC_P$ | $x/\sqrt{6}$ |
| $M_PC_P$ | x/2 |
| $M_PB_P$ | $x/2\sqrt{3}$ |
| Right Half "P" component edge lengths (refer to FIG. 10) | |
| $M_PD_P$ | x/2 |
| $B_PD_P$ | $x/\sqrt{3}$ |
| $C_PD_P$ | $x/\sqrt{2}$ |
| $B_PC_P$ | $x/\sqrt{6}$ |
| $M_PC_P$ | x/2 |
| $M_PB_P$ | $x/2\sqrt{3}$ |
| Left half "T" component angles (refer to FIG. 11a) | |
| $A_TM_TC_T$ | 90° |
| $A_TC_TM_T$ | 54° 44' |
| $M_TA_TC_T$ | 35° 16' |
| $A_TM_TB_T$ | 90° |
| $A_TB_TM_T$ | 60° |
| $M_TA_TB_T$ | 30° |
| $A_TB_TC_T$ | 90° |
| $A_TC_TB_T$ | 70° 32' |
| $B_TA_TC_T$ | 19° 28' |
| $M_TB_TC_T$ | 90° |
| $M_TC_TB_T$ | 54° 44' |
| $B_TM_TC_T$ | 35° 16' |
| Right Half T component angles (refer to FIG. 11b) | |
| $D_{TT}M_TC_T$ | 90° |
| $D_TC_TM_T$ | 54° 44' |
| $M_TD_TC_T$ | 35° 16' |
| $D_TM_TB_T$ | 90° |
| $D_TB_TM_T$ | 60° |
| $M_TD_TB_T$ | 30° |
| $D_TB_TC_T$ | 90° |
| $D_TC_TB_T$ | 70° 32' |
| $B_TD_TC_T$ | 19° 28' |
| $M_TB_TC_T$ | 90° |
| $M_TC_TB_T$ | 54° 44' |
| $B_TM_TC_T$ | 35° 16' |
| Left half "P" Component angles (refer to FIG. 12a) | |
| $A_PM_PC_P$ | 90° |
| $A_PC_PM_P$ | 45° |
| $M_PA_PC_P$ | 45° |
| $A_PM_PB_P$ | 90° |
| $A_PB_PM_P$ | 60° |
| $M_PA_PB_P$ | 30° |
| $A_PB_PC_P$ | 90° |
| $A_PC_PB_P$ | 54° 44' |
| $B_PA_PC_P$ | 35° 16' |
| $M_PB_PC_P$ | 90° |

-continued

| | |
|---|---|
| $M_PC_PB_P$ | 35° 16' |
| $B_PM_PC_P$ | 54° 44' |
| Right half "P" component angles (refer to FIG. 12b) | |
| $D_PM_PC_P$ | 90° |
| $D_PC_PM_P$ | 45° |
| $M_PD_PC_P$ | 45° |
| $D_PM_PC_P$ | 90° |
| $D_PC_PM_P$ | 60° |
| $M_PD_PC_P$ | 30° |
| $D_PB_PC_P$ | 90° |
| $D_PC_PB_P$ | 54° 44' |
| $B_PD_PC_P$ | 35° 16' |
| $M_PB_PC_P$ | 90° |
| $M_PC_PB_P$ | 35° 16' |
| $B_PM_PC_P$ | 54° 44' |

Figure 13:
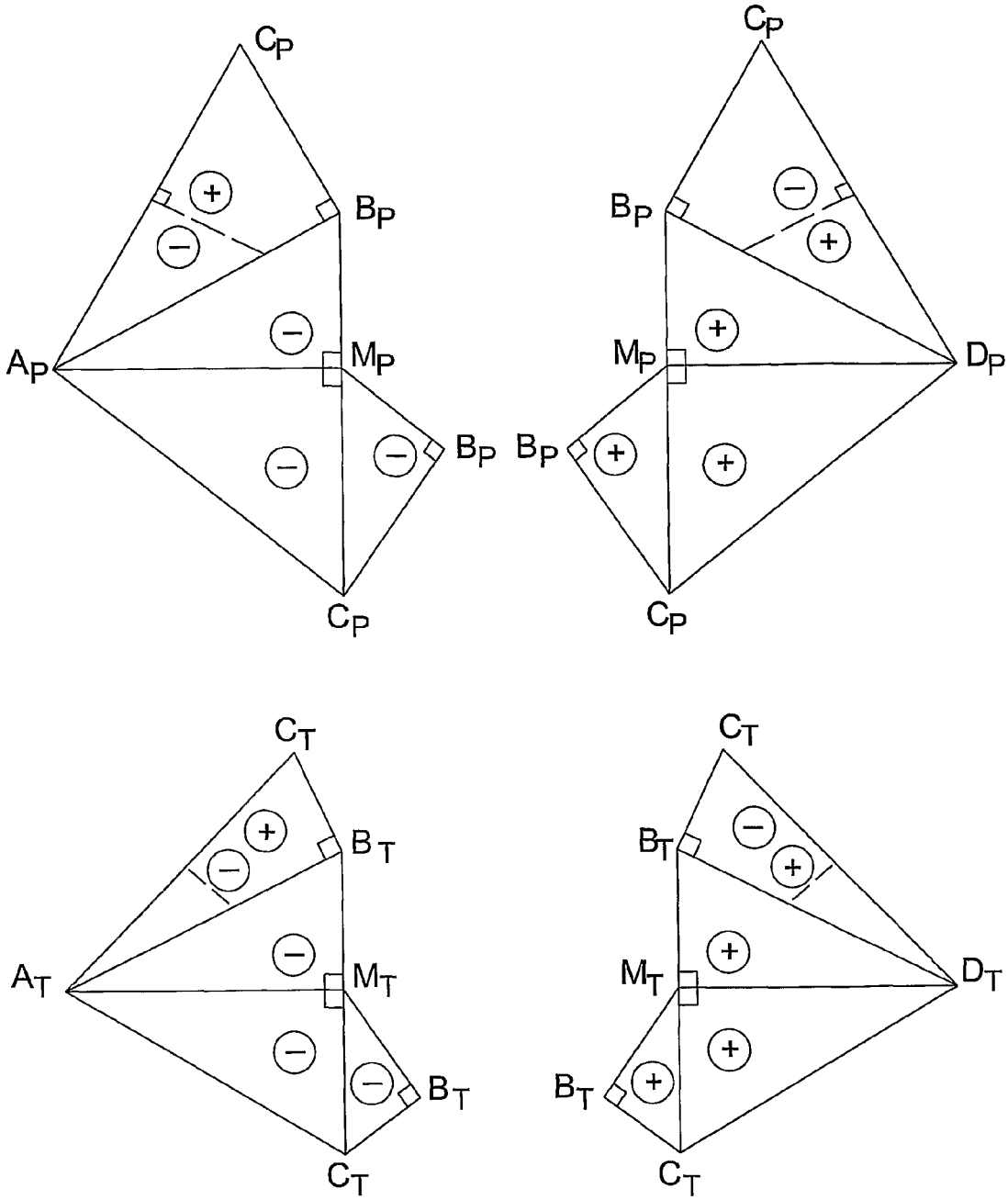
FIG. 13 shows the flat plan views that illustrate the location of the magnets inside the left half and right half "P" components according to one embodiment.

Referring to FIG. 13, the left half T and right half T components have a single magnet in the smallest of their four faces. The two magnets are of opposite polarity and located such that the two faces are attracted when the two components are brought close together and they completely overlap or match up when touching. The joined left and right half T components look almost identical to the whole T component. Similarly the left half P components and the right half P components have a single magnet in the smallest of their 4 faces. These two magnets are of opposite polarity and located such that when the two components are brought close together they are attracted and completely overlap. The joined left and right half P components look almost identical to the whole P component. Again, it will be appreciated that the fasteners are not restricted to magnets but that any type of suitable fastener can be used.

The ½ P and ½ T components are interesting because they enable construction of double size P and a double size T components that cannot be constructed with whole P and whole T pieces. They also enable construction of some other interesting geometric shapes which cannot be constructed with whole P and whole T pieces. They are intended to be used in conjunction with whole P and whole T pieces to give added strength to the constructions. This advanced kit with the ½ P and ½ T components are completely compatible with other level kits in terms of colours (if necessary), piece dimensions and considerations of magnet placement.

In addition, each component contemplated by this invention can be made to any scale. For example, the double scale T component comprises: 2(left ½ P+right ½ P+left ½ T+right ½ T+T)=(2T+2 left ½ P+2 right ½ c P+2 left ½ T+2 right ½ T) components. This component has the same volume as 8 T components because the volume of a P component is equal to the volume of two T components.

The double scale P component comprises: 2(left ½ P+right ½ P+left ½ T+right ½T+2P+T)=(4P components ½ T components ½ left ½ P+2 right ½ P+2 left ½ T+2 right ½ T) components. This component has the same volume as 8 P components.

The double scale left and right ½ T components each comprise (a left ½ P+a right ½ P+a left ½ T+a right ½ T+a T) components. The double scale left and right ½ P components each comprise (a left ½ P+a right ½ P+a left ½ T+a right ½ T+2P+a T) components.

The double size PT component is seen in FIG. 28. It requires whole "P" and "T" units for its construction. The double size PT construction does not require half "T" or half "P" units.

Two PT constructions can be joined together in a few different ways. Some examples are: a) to form a small square based pyramid with four identical isosceles triangular faces b) to form a rhombic based pyramid also with four identical isosceles triangular faces c) to form a tetrahedron d) to form the mirror image of the tetrahedron described in c).

Figure 14:
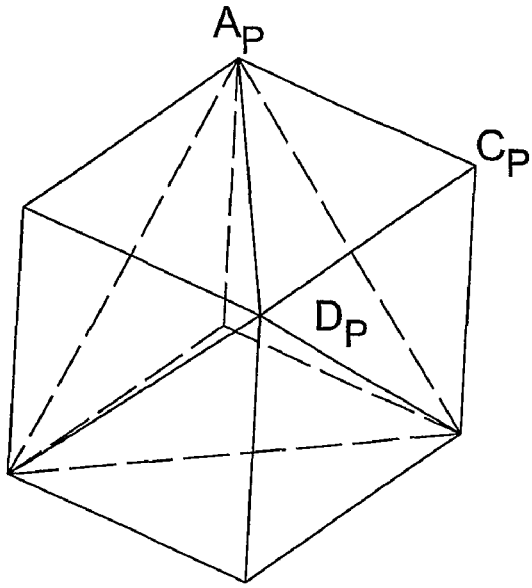
FIG. 14 shows isometric view of regular cube constructed with 12 "P" and 12 "T" components in accordance with the teachings of the present invention.
Figure 15:
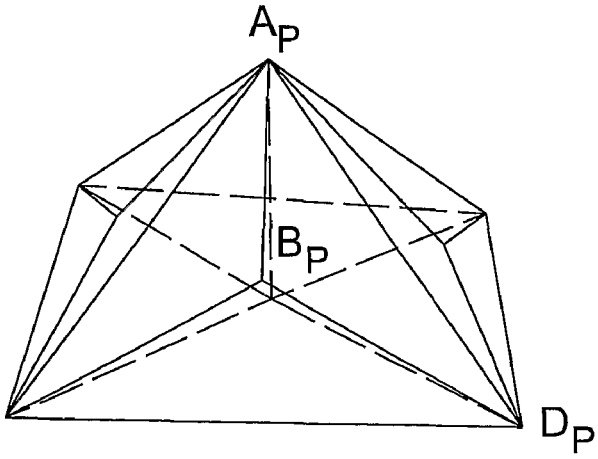
FIG. 15 shows isometric view of the regular square based pyramid constructed with 12 "P" components.
Figure 15A:
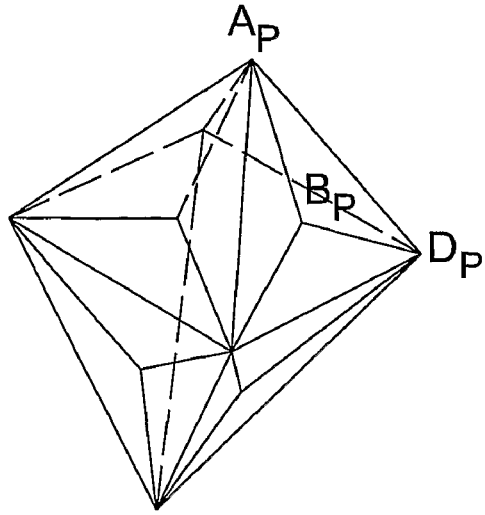
FIG. 15*a* shows isometric view of a regular octahedron constructed with 24 "P" components.
Figure 16:
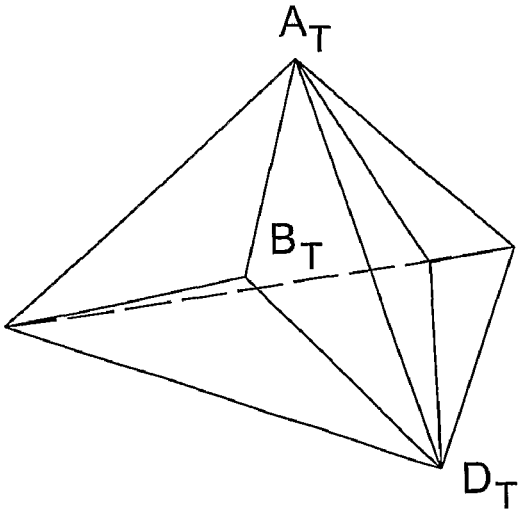
FIG. 16 shows isometric view of the regular tetrahedron that can be constructed with 12 "T" components.

Referring to FIG. 14, this is shown an isometric view of one regular cube, or system. As mentioned above, this cube comprises 12 P components and 12 T components, with the T components forming the exterior of the cube. The components of this cube can further form a square based regular pyramid and a regular tetrahedron. Referring to FIG. 15, the P components of the cube can be assembled into the square based regular pyramid. Referring to FIG. 16, the T components can be assembled into the regular tetrahedron.

Figure 17:
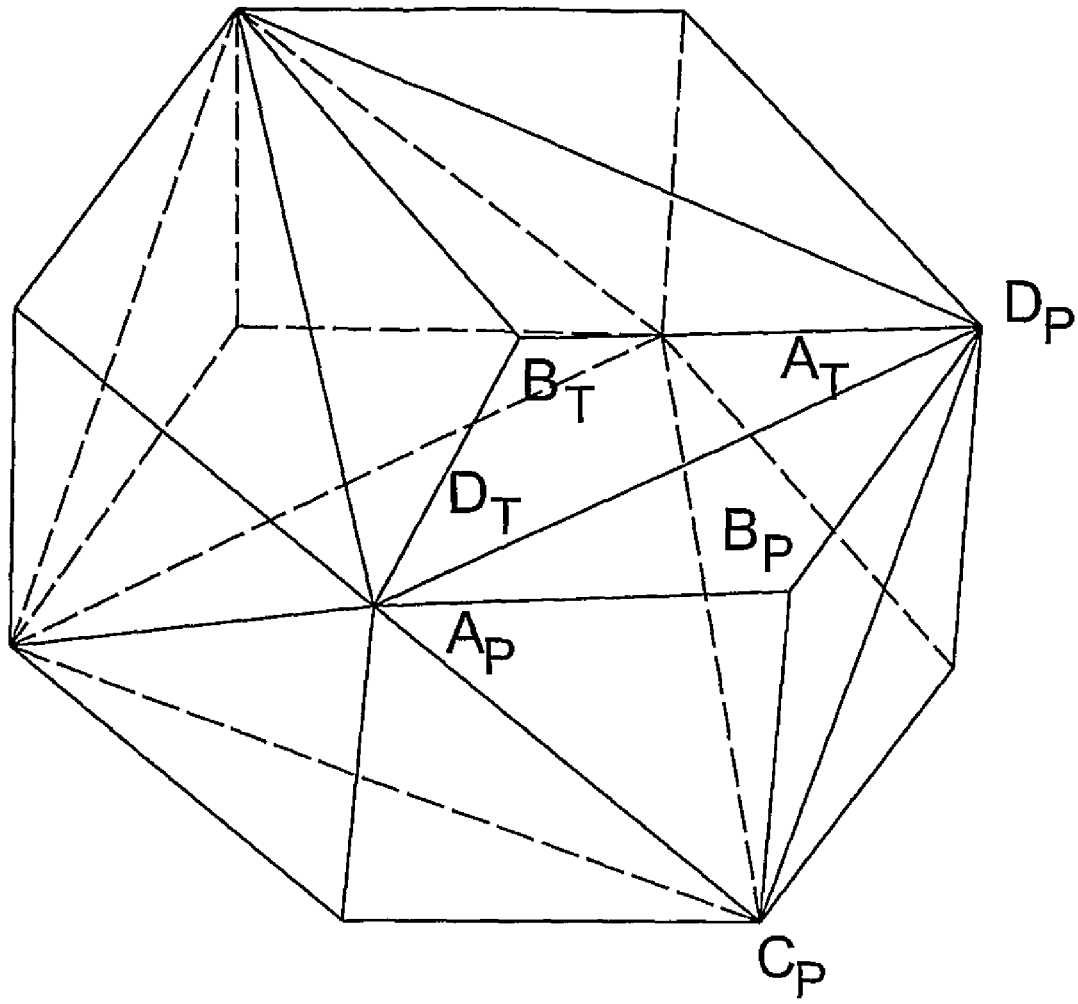
FIG. 17 illustrates the hexagon that can be constructed from the same 12 "P" and 12 "T" components used to make the cube of FIG. 14.

The ultimate solution to the single cube puzzle is to assemble all of the components into a hexagonal shape, as seen in FIG. 17. Here, 6 "T" components form the centre triangle of the exterior of the top and another 6 "T" components form the centre triangle of the base. The other external surfaces of the top, bottom and sides of the hexagon shape are made from 12 "P" pieces.

Figure 18:
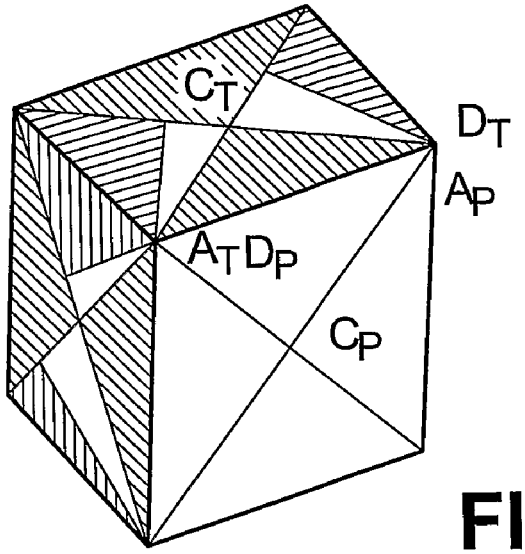
FIG. 18 illustrates the 24 "P" and 24 "T" components assembled into a rectangular sided box shape in accordance with the teachings of the present invention.

The rectangular sides box shown in FIG. 18 can be constructed with 24 "P" components and 24 "T" components. This is the same number of components as it takes to construct two cubes.

Figure 19:
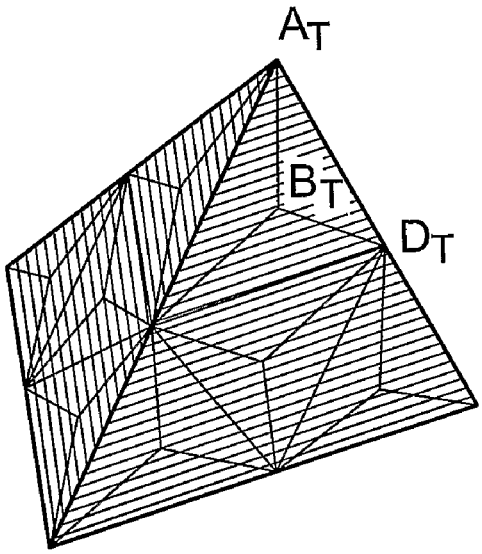
FIG. 19 shows how 48 "T" and 24 "P" components form a larger regular tetrahedron exactly double the size of the regular tetrahedron formed by 12 "T" components.
Figure 20:
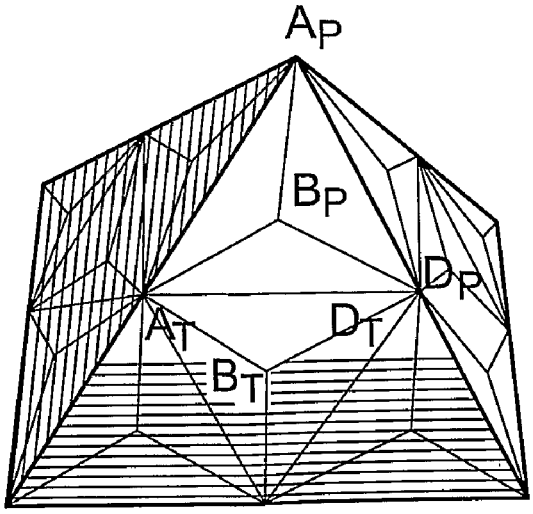
FIG. 20 shows how 72 "P" and 48 "T" components form a larger square based regular pyramid that is exactly double the size of the regular pyramid formed by 12 "P" components.

FIGS. 19 and 20 show that 24 "P" and 48 "T" components can be assembled into double size regular tetrahedron and 72 "P" and 48"T" can be assembled into a double size regular pyramid Some examples of shapes that can be assembled are outlined in the table below. As one normally skilled in the art will appreciate, this list is not exhaustive and it exemplary only.

| Shape | Number of P components | Number of T components |
|---|---|---|
| Cube | 12 | 12 |
| Regular hexagon | 12 | 12 |
| Square based pyramid with 4 identical isosceles triangle faces | 2 | 2 |
| Rhombic base pyramid | 2 | 2 |
| ¼ Rhombic dodecahedron (Rhombic hexahedron) | 6 | 6 |
| Regular square based pyramid with 4 equilateral triangle faces | 12 | 0 |
| Regular tetrahedron with 4 equilateral triangle faces | 0 | 12 |
| Regular octahedron | 24 | |
| Rectangular box with 4 rectangular faces and 2 square faces | 24 | 24 |
| Rhombic dodecahedron (two forms) | 24 | 24 |
| Pentagram (sloping sides) | 30 | 30 |
| Double size regular Tetrahedron | 24 | 48 |
| Double size regular Pyramid | 72 | 48 |
| Cuboctahedron | 72 | 96 |
| Pentagon (vertical sides) | 60 | 50 |
| Icosahedral shell | 0 | 120 |
| Pentagonal dodecahedron (hollow) | 120 | 120 |

Figure 23:
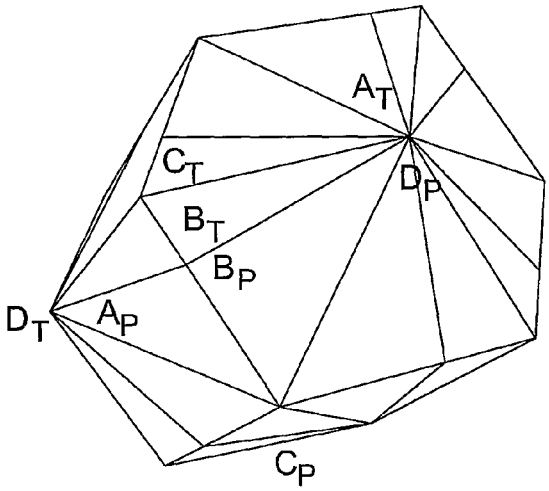
FIGS. 23 and 24 show the two different forms of the rhombic dodecahedron (12 rhombic faces and all 24 edges the same length) constructed with 24 "P" components and 24 "T" components.
Figure 24:
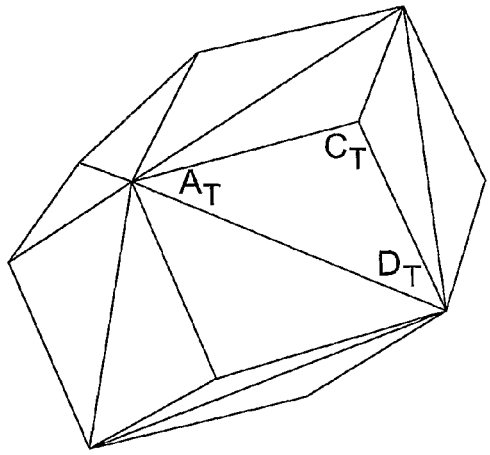
Figure 25:
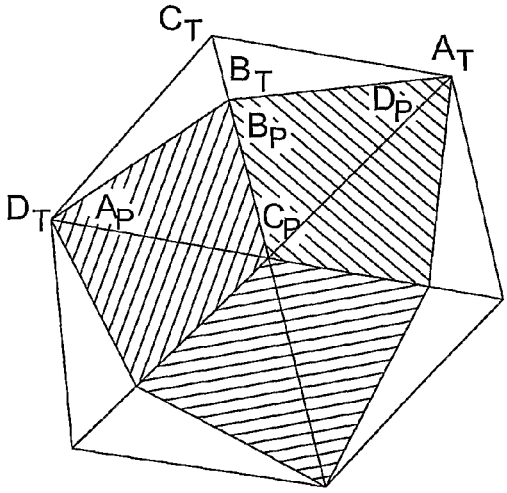
FIGS. 25 and 26 show the top and bottom views of the Rhombic Hexahedron (6 rhombic faces and all 12 edges the same length) constructed from 6 "P" components and 6 "T" components.
Figure 26:
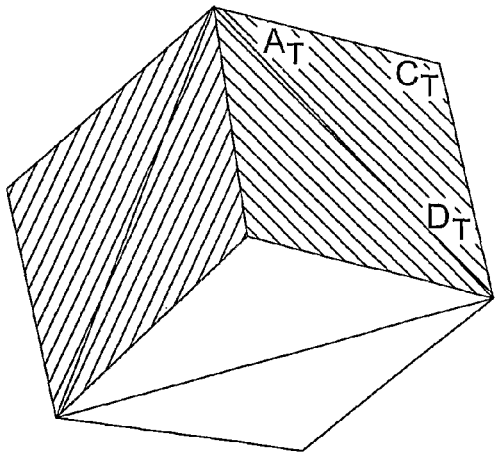

By way of example only, a few shapes that can be assembled are illustrated. FIG. 21 shows a top view of the pentagram, and FIG. 22 shows the bottom view of the same pentagram construction. FIGS. 23 and 24 each show a different solution to form a rhombic dodecahedron, each using the same components. FIGS. 25 and 26 the top and bottom of the rhombic hexahedron (6 rhombic faces). Four of these rhombic hexahedron shapes will make two different versions of the rhombic dodecahedron shown in FIGS. 23 and 24.

In one embodiment, the randomly selected preference for the size of the P and T pieces is where x=about 10 cm. This results in pieces that are easily and comfortably manipulated and give sufficient internal space to accommodate the necessary magnets. The edges of the pieces may be slightly rounded and the vertexes blunted somewhat to ensure the safety of the users of the toy. This rounding and blunting has to be done with caution to ensure the angles between the faces and the relative lengths of the sides does not change. Cost issues dictate the choice of magnets that are preferred in this invention and this is variable with market conditions. The ratio of magnet strength to the weight of the P and T pieces is a key factor also. The metal or ceramic disc magnets constitute a preferred choice. The attractiveness regarding manufacture is that there are just two parts to the basic system. Only two plastic moulds are required for the basic level kits and this reduces the cost of manufacture. The manufacture of the bisected T and P pieces for the advanced level kit is obviously somewhat more complicated as there are 4 different pieces instead of two.

Referring to FIGS. 29*a* to 29*d*, 30*a* to 30*d*, 31*a* to 31*d*, 32*a* to 32*d*, 33*a* to 33*d*, 34*a* to 34*d*, the interest and challenge of the puzzle can be further enhanced by introducing six curved components.

These six curved components are called TS, CS, OS, RDS, ICS and PDS pieces. The level of the kit will dictate which set of curved pieces is included.

Twelve of the curved TS pieces convert the regular tetrahedron (former by 12 "T" pieces) into a sphere. Twelve of the curved CS pieces convert the cube (formed by 12 "T" pieces and 12 "P" pieces) into a sphere. Twenty four of the OS pieces convert the Octahedron (formed by 24 "P" pieces) into a sphere. Twenty four of the RDS pieces convert the rhombic dodecahedron (formed by 24 "T" pieces and 24 "P" pieces) into a sphere. Sixty of the ICS pieces convert the Icosahedron into a sphere. Sixty of the PDS pieces convert the pentagonal dodecahedron into a sphere.

The curved surface of the TS, CS, OS, RDS, ICS and PDS pieces may have designs, patterns or portions of a recognizable spherical object imprinted or imposed upon its surface such that when the set of curved pieces are placed in the correct location the spherical puzzle is solved correctly. For instance, portions of the map of the world could be imposed in to surface of the pieces. When the pieces are assembled correctly on the surface of the cube the map of the world is apparent.

Another version of the TS, CS, OS, RDS, ICS and PDS pieces is where some of the pieces are made of whitish material that glows in the dark. Two or three of the pieces have the pupil of an eye inscribed on their curved surface. When the pieces are placed on the surface of their respective geometric shape to form a sphere they resemble a glow in the dark eye ball.

Another version of the curved pieces may have reflective mirrored curved surface such that when the pieces are placed on the surface of their respective geometric shape to form a sphere the result is a mirrored sphere.

Figure 29A:
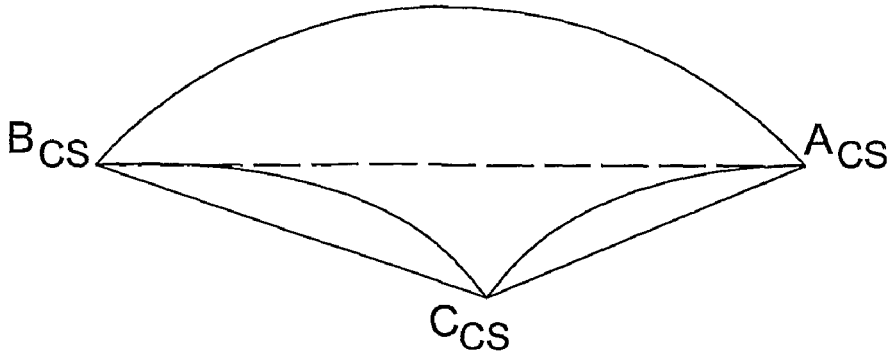
FIGS. 29 *a, b, c* and *d* illustrate one of the 12 identical curved "CS" pieces used to convert a cube shown in FIG. 14 into a sphere.
Figure 29B:
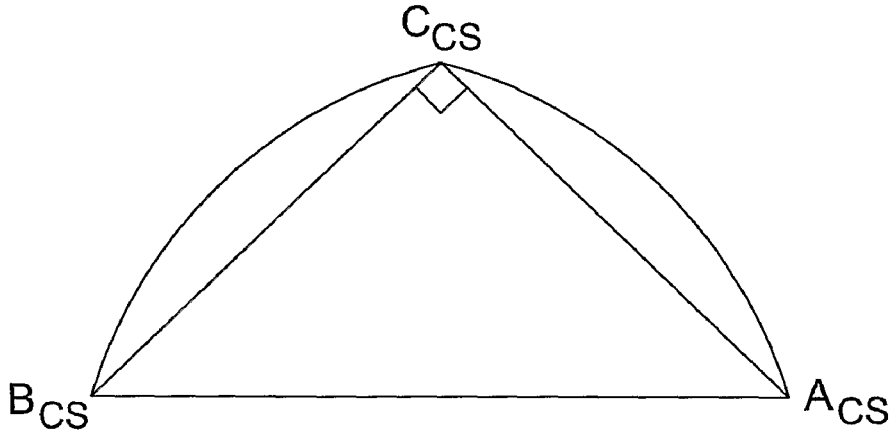
Figure 29C:
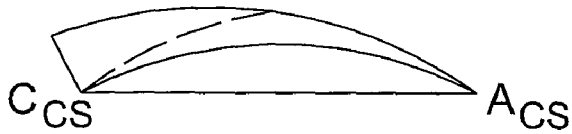
Figure 29D:
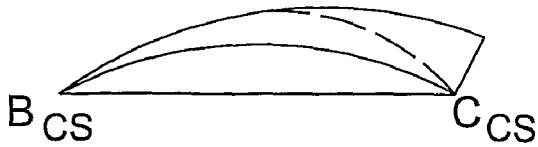

Referring to FIGS. 29*a,b,c* and *d* there is illustrated one of the CS pieces which can be added to the cube (formed by 12 "P" and 12 "T") to convert it into a sphere.

The CS piece has 5 surfaces wherein four surfaces are flat and one surface is curved. Two of the four flat surfaces of the CS piece are identical. These two identical faces each have one straight edge and one curved edge. They are precisely described as the chord of a circle of radius $x\sqrt{3}/2\sqrt{2}$ where the straight edge of the chord has length $x/\sqrt{2}$. Each of these faces is attached at an angle of 135 degrees to the triangular base of the CS piece.

The third flat surface of the CS piece has one straight edge and one curved edge. It is described as a chord of a circle radius $x\sqrt{3}/2\sqrt{2}$ where the straight edge of the chord has length x.

The fourth flat surface of the CS piece is a right angled triangle. This triangular face is identical to the largest face of the "P" piece. (Triangle ApCpDp shown in FIG. 3) This triangular face has two sides that are length $x/\sqrt{2}$ and a third side has length x. This surface has magnets imbedded in its surface in the same locations as the corresponding face of the "P" piece. The "P" piece and the CS piece will be attracted to one another by the magnetic attraction when their matching faces are brought together in such a way as there is precise matching and no overlap of their edges.

The fifth surface of the CS piece, is the curved surface, and it is equivalent to one twelfth of the surface of a sphere radius $x\sqrt{3}/2\sqrt{2}$. The profile of the curved surface is triangular when viewed from above. This curved surface is bounded on three sides by three curved edges. One edge is the curved edge of the chord length x and the other two edges are the curved edges of chords of length $x/\sqrt{2}$.

When twelve of the CS pieces are arranged on the surface of a cube made by twelve P pieces and twelve T pieces the result is a sphere radius $x\sqrt{3}/2\sqrt{2}$. The CS pieces are held on the surface of the cube by magnetic attraction of the magnets imbedded in the CS piece and the magnets imbedded in the face of the P pieces exposed on the surface of the cube. The CS pieces are held in a precise location because the magnets are precisely placed in the surface of the CS piece.

Figure 30A:
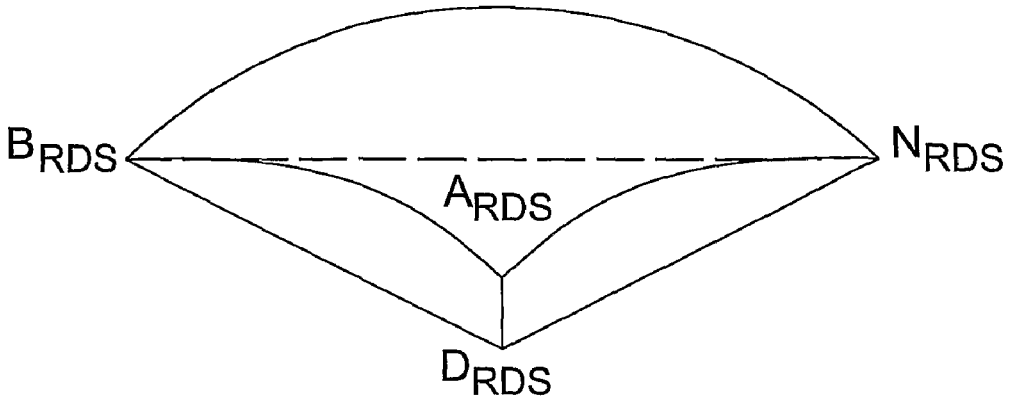
FIGS. 30*a,b,c* and *d* illustrate one of the 24 identical curved RDS pieces used to convert a rhombic dodecahedron shown in FIG. 24 into a sphere.
Figure 30B:
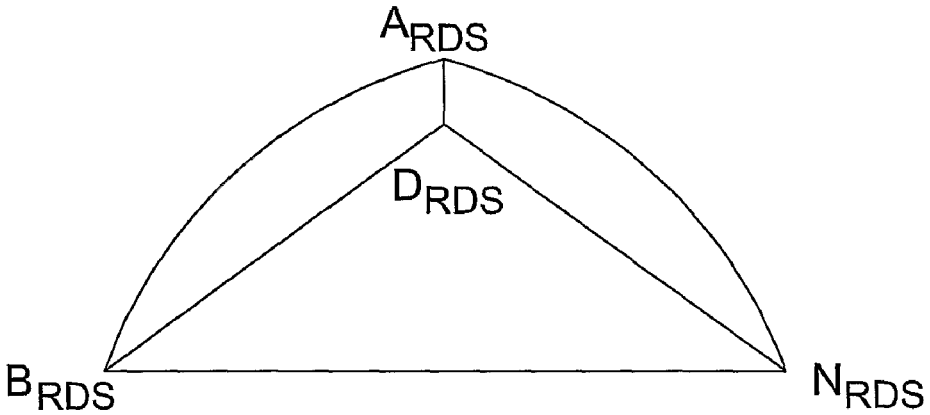
Figure 30C:
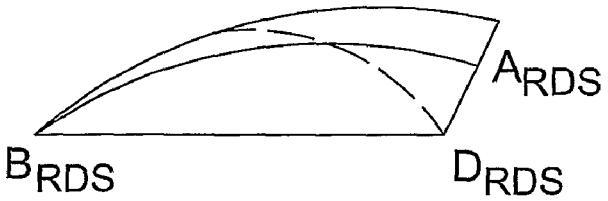
Figure 30D:
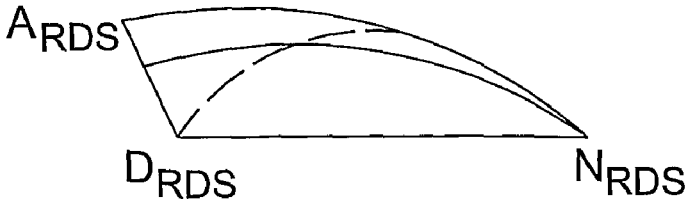

FIGS. 30*a,b,c* and *d* describe the curved RDS piece that convert the Rhombic Dodecahedron edge $x\sqrt{3}/2\sqrt{3}$ {formed by 24 "P" pieces and 24 "T" pieces (see FIG. 24)} into a sphere.

Referring to FIG. 24, the rhombic dodecahedron referred to in this description has twelve (12) faces, each a regular rhombus. It has fourteen (14) vertices and twenty four (24) edges. All the edges have the same length and are equal to $x\sqrt{3}/2\sqrt{3}$. The rhombic dodecahedron is composed of 24 "P" pieces and 24 "T" pieces.

When twenty four of the "RDS" pieces are placed on the twenty four corresponding faces of the "T" pieces exposed on the surface of the rhombic dodecahedron, a sphere of radius $x/\sqrt{2}$ is formed.

The RDS piece has 5 surfaces four are flat and one is curved. The curved surface has three vertices and is bounded on three sides by three flat faces. These three flat faces each have a curved edge. The curved edge of one of the faces is described by the curved edge of the chord length x of circle radius $x/\sqrt{2}$. The curved edges of the other faces are of identical length and are the arcs of segments (angle 54 degrees 44 minutes) of circles of radius $x/\sqrt{2}$. The three faces are attached to the corresponding edges of a triangle identical to the largest face of the "T" piece seen in FIG. 4.

One of the four flat surfaces of the RDS piece is an isosceles triangle with two edges of length $x\sqrt{3}/2\sqrt{2}$ and a third edge of length x. This face of the RDS piece is identical in size and shape to the largest face of the "T" piece. (triangle $A_TC_TD_T$ of the T piece shown in FIG. 4).

Magnets are placed in this triangular face of the RDS piece in identical places as they are in the corresponding face of the "T" piece. The "T" piece and the RDS piece will be attracted to one another by the magnetic attraction when their matching faces are brought together in such a way as there is precise matching and no overlap of their edges.

Figure 37:
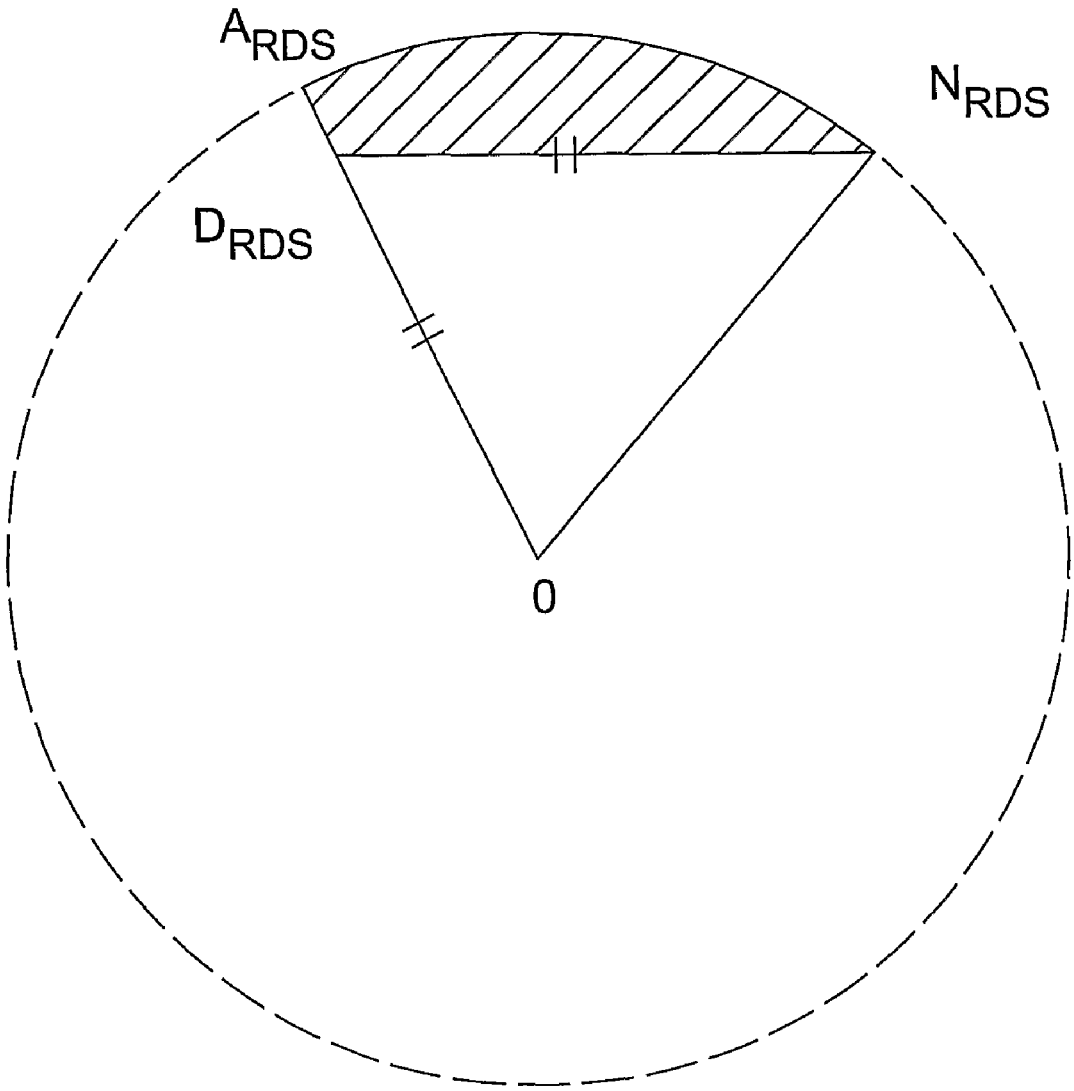
FIG. 37 illustrates the derivation of the shape of one of the RDS faces.

Two of the four flat surfaces of the RDS piece are the same shape as each other. They are identical. The shape of these two identical flat surfaces (ArdsDrdsNrds and ArdsDrdsBrds) can be described as a "portion of a segment" of a circle of radius $x/\sqrt{2}$. The portion of the segment of the circle is derived as described below. (see FIG. 37)

The angle of the segment of the circle is 54 degrees 44 minutes.

The point Drds on radius of the circle $x/\sqrt{2}$ is located such that length DrdsO=length DrdsNrds.

Therefore triangle DrdsNrdsO is an isosceles triangle.

Therefore angle DrdsNrdsO=54 degrees 44 minutes.

Therefore angle ODrdsNrds=180−2(54 degrees 44 minutes)=70 degrees 32 minutes.

Therefore angle ArdsDrdsNrds=109 degrees 28 minutes

Described below is the calculation of length ArdsDrds.

$$\begin{aligned} ArdsDrds &= x/\sqrt{2} - (\text{length } C_TD_T \text{ of the } T \text{ piece} \\ &= x/\sqrt{2} - x\sqrt{3}/2\sqrt{2} \\ &= x/\sqrt{2}(1-\sqrt{3}/2) \end{aligned} \quad \text{(Figure 4)}$$

The RDS piece has two identical flat surfaces each equivalent to shape ArdsDrdsNrds in FIG. 30*a*.

ArdsDrds=$x/\sqrt{2}$ $(1-\sqrt{3}/2)$ DrdsNrds=$x\sqrt{3}/2\sqrt{2}$

ArdsNrds=the arc of the segment of circle radius $x/\sqrt{2}$ where the angle of the segment=54 degrees 44 minutes.

Faces ArdsDrdsNrds and ArdsDrdsBrds of the RDS are each attached at an angle of 120 degrees to the triangular base face BrdsDrdsNrds. It is the $x\sqrt{3}/2\sqrt{2}$ edge of the ArdsDrdsNrds face and the BrdsDrdsNrds face that are attached to the corresponding length edges of the triangular face BrdsDrdsNrds. The two ArdsDrds lengths of the ArdsDrdsNrds and ArdsDrdsBrds pieces are joined.

The fourth of the four flat surface of the RDS piece has one flat edge and one curved edge. It is equivalent to a chord, length x, of a circle radius $x/\sqrt{2}$.

The fifth surface of the RDS piece is curved and is equivalent to one twenty fourth of the surface of a sphere radius $x/\sqrt{2}$. The curved surface is essentially triangular in profile (i.e it appears essentially triangular when viewed from above.) This curved surface is bounded on three sides by three curved edges. One curved edge is equivalent to the arc of a chord length x of circle radius $x/\sqrt{2}$ and the other two edges are the arcs of segments of circles of radius $x/\sqrt{2}$. The segments have an angle of 54 degrees 44 minutes.

Magnets can be sunk into each of the flat surfaces of the RDS pieces such that when the RDS pieces are placed on the surface of the rhombic dodecahedron they are held firmly in place.

Two Magnets are placed equidistant from the axis of symmetry of each flat face. There are four flat faces therefore each RDS piece has eight magnets. The critical magnets are those in the triangular face since these are the ones in contact with the rhombic dodecahedron.

Figure 33A:
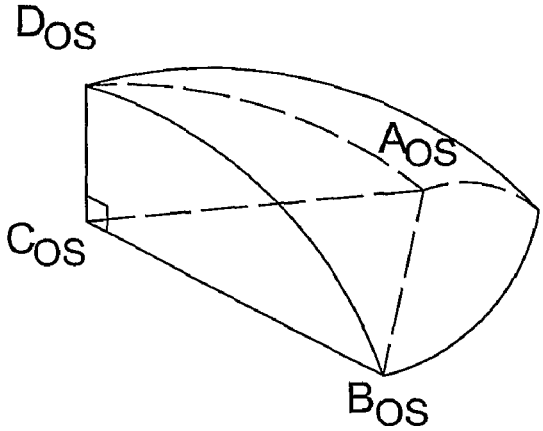
FIGS. 33 *a,b,c* and *d* illustrate one of the 24 identical curved OS pieces used to convert a regular Octahedron shown in FIG. 15*a* into a sphere.
Figure 33B:
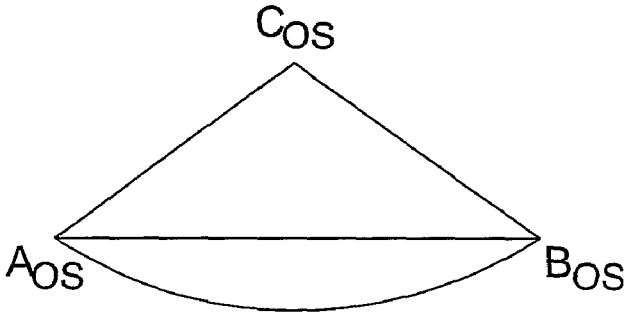
Figure 33C:
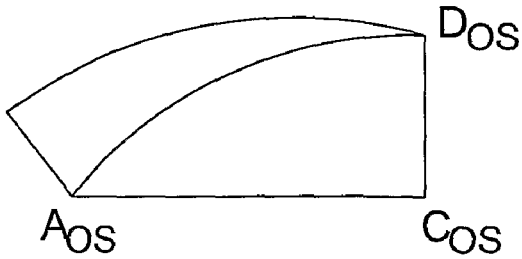
Figure 33D:
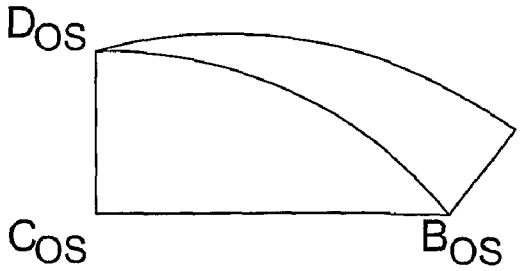

Referring to FIGS. 33*a,b,c* and *d* illustrated the OS pieces which can be added to the regular octahedron (FIG. 15*a*) formed by 24 "P" pieces, to convert it into a sphere.

The OS piece has 5 surfaces wherein four surfaces are flat and one surface is curved. Two of the four flat surfaces of the OS piece are identical. These two identical faces have two straight edges and one curved edge. The identical faces are precisely described as half the chord of a circle of radius $x/\sqrt{2}$ where the straight edge of the chord has length $2x/\sqrt{3}$. Length CosBos=$x/\sqrt{3}$. Length DosCos=$x/\sqrt{2}-x/\sqrt{6}$. Each of these faces is attached at an angle of 90 degrees to the triangular base of the OS piece.

The third flat surface of the OS piece has one straight edge and one curved edge. It is described as a chord of a circle radius $x/\sqrt{2}$ where the straight edge of the chord has length x. It is attached to the longest edge of the fourth surface described below at an angle of 125 degree 16 minutes (i.e. 180 degrees minus 54 degrees 44 minutes)

Figure 3:
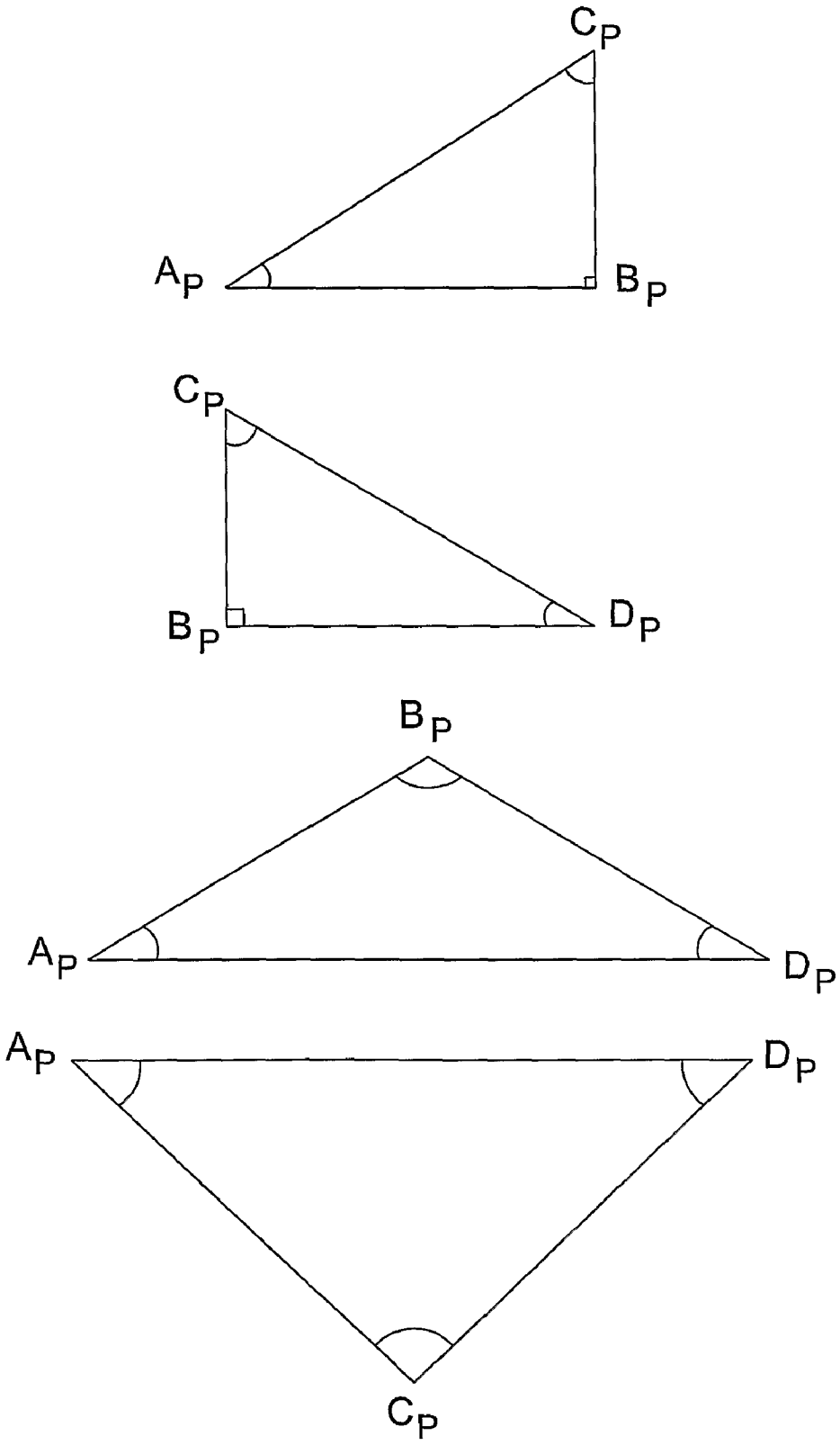
FIG. 3 illustrates the four triangular faces of the "P" component of FIG. 2*a;*
Figure 4:
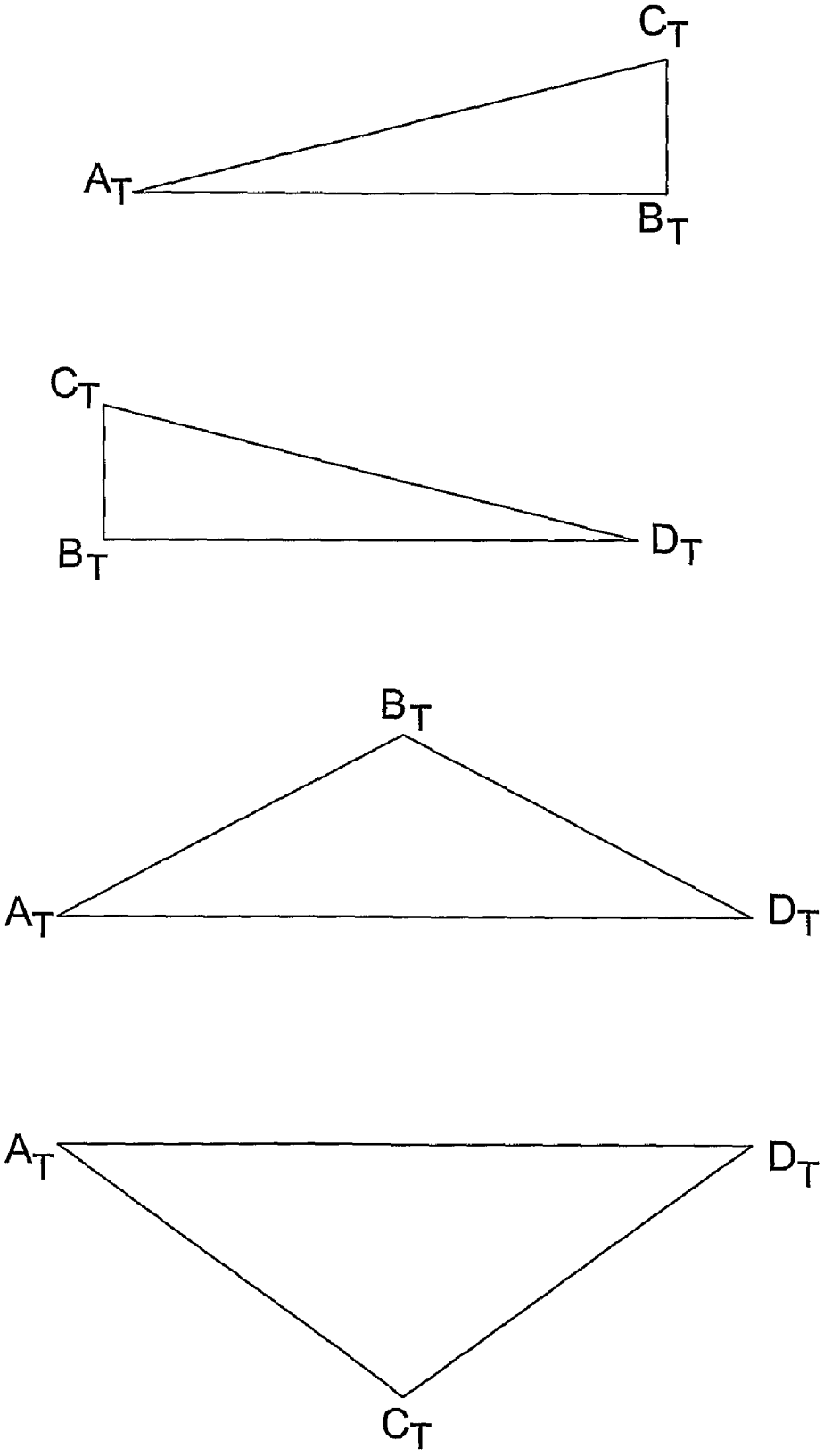
FIG. 4 illustrates the four triangular faces of the "T" component of FIG. 1*a;*
Figure 5A:
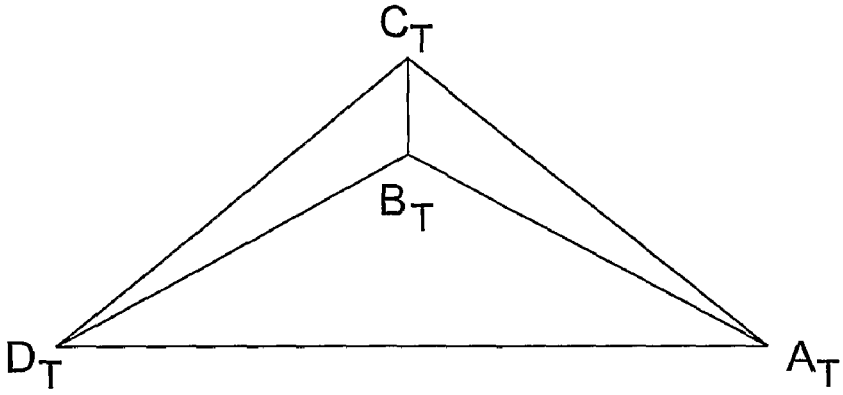
FIGS. 5*a*, 5*b* and 5*c* illustrate a top view, side view and bottom view, respectively of the T component of FIG. 1*a;*
Figure 5B:
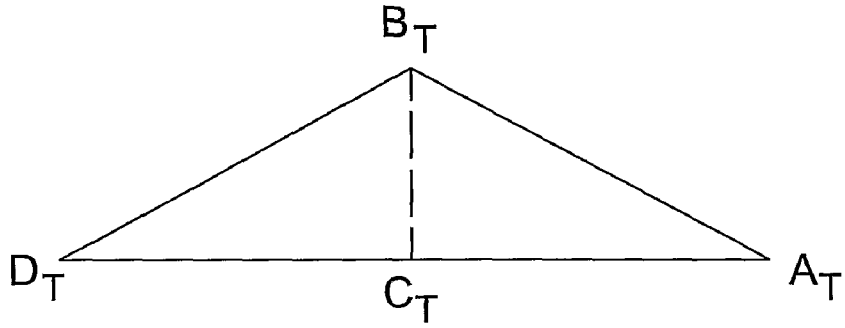
Figure 5C:
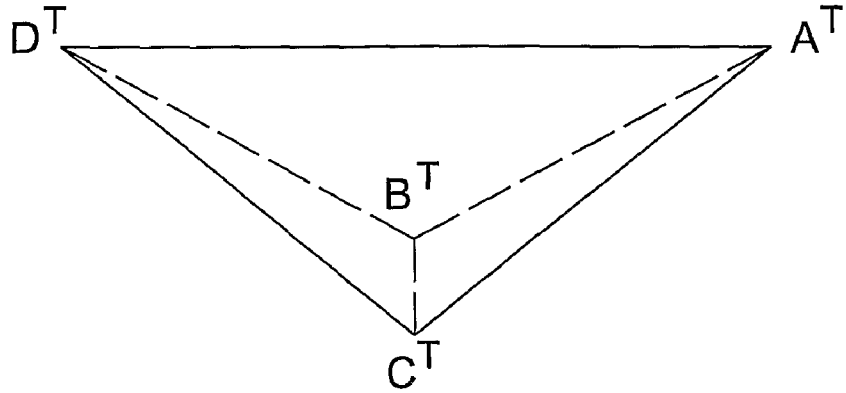
Figure 6A:
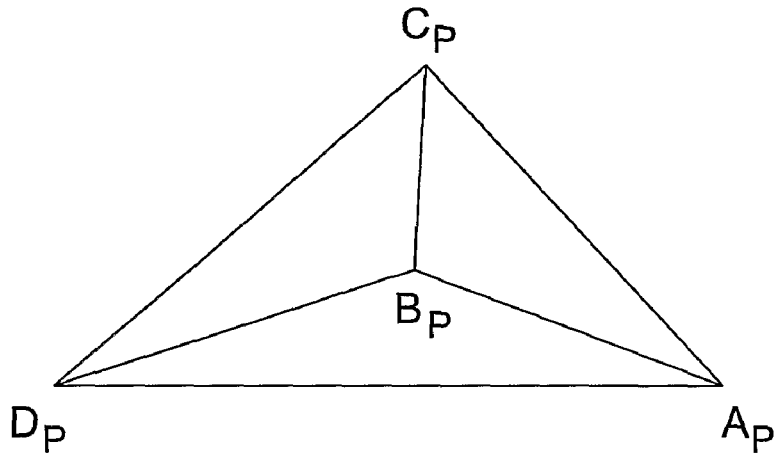
FIGS. 6*a*, 6*b*, and 6*c* illustrate a top view, side view and bottom view, respectively of the P component of FIG. 2*a;*
Figure 6B:
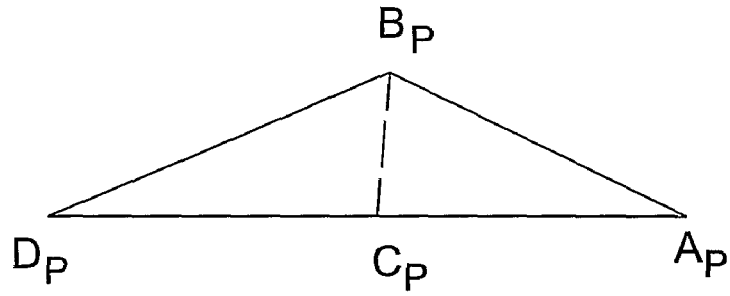
Figure 6C:
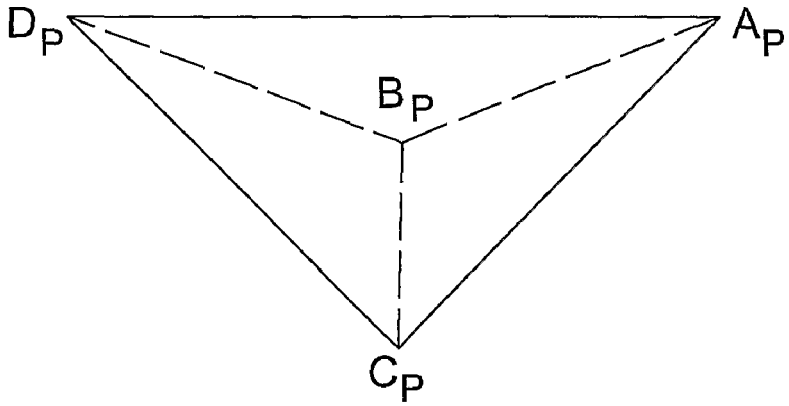

The fourth flat surface of the OS piece is a triangle (AosBosCos) This triangular face is identical to one of the triangular faces (ApDpBp) of the "P" piece (FIG. 3). This triangular face has two sides that are length $x/\sqrt{2}$ and a third side has length x. The internal angles are 30, 30 and 120 degrees. This surface has magnets imbedded in its surface in the same locations as the corresponding face (ApDpB) of the "P" piece. The "P" piece and the OS piece will be attracted to one another by the magnetic attraction when their matching faces are brought together in such a way as there is precise matching and no overlap of their edges.

The fifth surface of the OS piece, is the curved surface, and it is equivalent to one twenty fourth of the surface of a sphere radius x/<2. The profile of the curved surface is triangular when viewed from above. This curved surface is bounded on three sides by three curved edges. One edge is the curved edge of the chord length x and the other two edges are the curved edges of half chords of length $2\times/\sqrt{3}$.

When twelve of the OS pieces are arranged on the surface of a regular octahedron made by twenty four P pieces the result is a sphere radius $x/\sqrt{2}$. The OS pieces are held on the surface of the regular octahedron by magnetic attraction of the magnets imbedded in the OS piece and the magnets imbedded in the face of the P pieces exposed on the surface of the regular octahedron. The OS pieces are held in a precise location because the magnets are precisely placed in the surface of the OS piece.

Figure 34A:
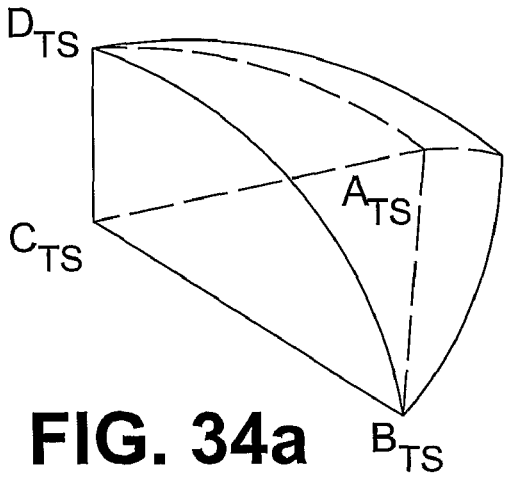
FIGS. 34 *a,b,c* and *d* illustrate one of the 12 identical curved TS pieces used to convert a regular tetrahedron shown in FIG. 16 into a sphere.
Figure 34B:
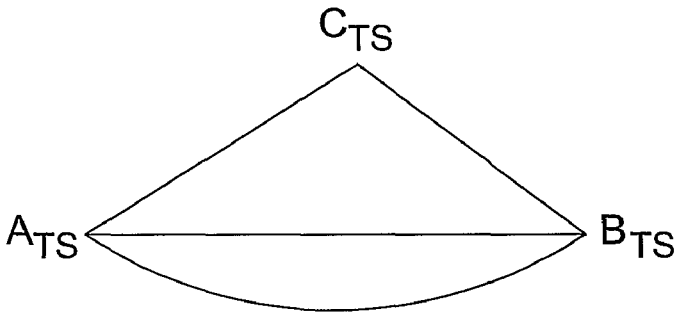
Figure 34C:
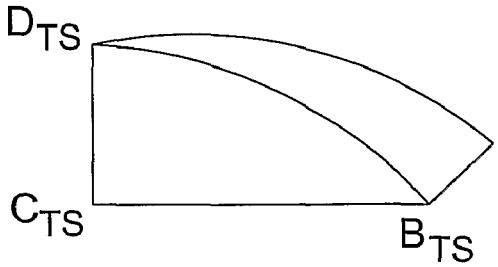
Figure 34D:
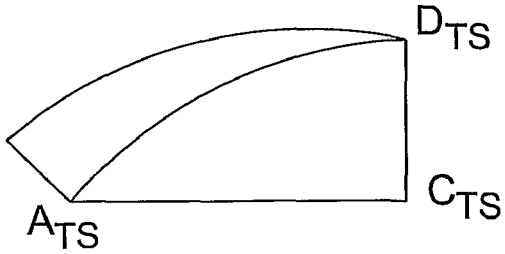

Referring to FIGS. 34*a,b,c* and *d* illustrate one of the 12 TS pieces which can be added to the regular Tetrahedron (formed by 12 "T" pieces) to convert it into a sphere.

The TS piece has 5 surfaces wherein four surfaces are flat and one surface is curved. Two of the four flat surfaces of the TS piece are identical. These two identical faces (DtsCtsAts and DtsCtsBts) each have two straight edges and one curved edge. They are precisely described as half the chord of a circle of radius $x\sqrt{3}/2\sqrt{2}$ where the straight edge of the chord has length $2\times/\sqrt{3}$. CtsBts=CtsAts=$x/\sqrt{3}$, DtsCts=$x-x\sqrt{3}/2\sqrt{2}-x/2\sqrt{6}$.=$x-x/\sqrt{6}$ Each of these faces is attached at an angle of 90 degrees to the triangular base (AtsBtsCts) of the TS piece.

The third flat surface of the TS piece has one straight edge and one curved edge. It is described as a chord of a circle radius $x\sqrt{3}/2\sqrt{2}$ where the straight edge of the chord has length x. This face is attached to the longest edge of the triangular face of the TS piece.

The fourth flat surface of the TS piece is a triangle This triangular face is identical to one of the triangular faces of the "T" piece. This triangular face has two sides that are length $x/\sqrt{2}$ and a third side has length x. The internal angles are 30, 30 and 120 degrees. This surface has magnets imbedded in its surface in the same locations as the corresponding face of the "T" piece. The "T" piece and the TS piece will be attracted to one another by the magnetic attraction when their matching faces are brought together in such a way as there is precise matching and no overlap of their edges.

The fifth surface of the TS piece, is the curved surface, and it is equivalent to one twelfth of the surface of a sphere radius $x\sqrt{3}/2\sqrt{2}$. The profile of the curved surface is triangular when viewed from above. This curved surface is bounded on three sides by three curved edges. One edge is the curved edge of the chord length x and the other two edges are the curved edges of half chords of length $2\times/\sqrt{3}$.

When twelve of the TS pieces are arranged on the surface of a regular tetrahedron made by twelve T pieces the result is a sphere radius $x\sqrt{3}/2\sqrt{2}$. The TS pieces are held on the surface of the regular tetrahedron by magnetic attraction of the magnets imbedded in the TS piece and the magnets imbedded in the face of the T pieces exposed on the surface of the regular tetrahedron. The TS pieces are held in a precise location because the magnets are precisely placed in the surface of the TS piece.

Figure 31A:
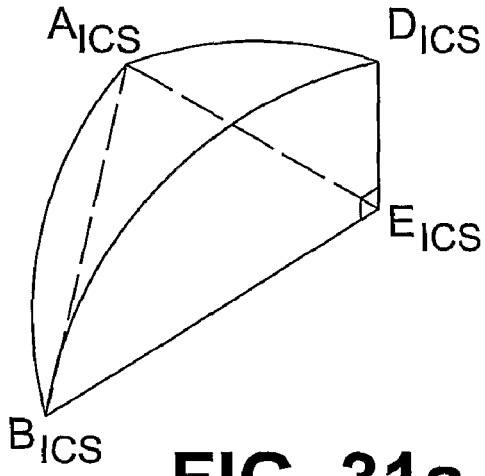
FIGS. 31*a,b,c* and *d* illustrate one of the 60 identical curved ICS pieces used to convert an icosahedron shown in FIG. 35 into a sphere.
Figure 31B:
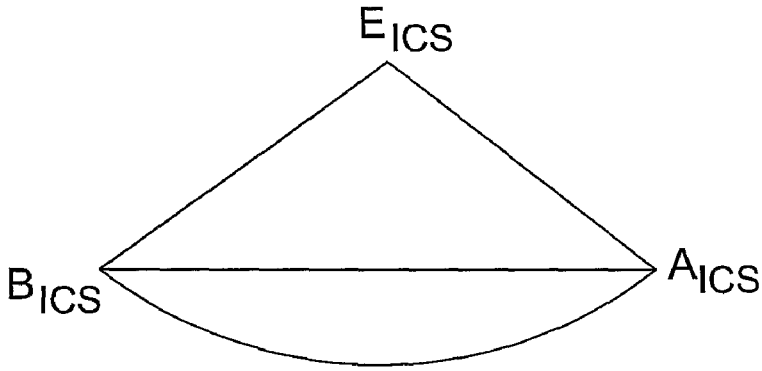
Figure 31C:
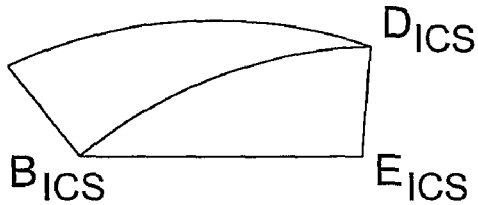
Figure 31D:
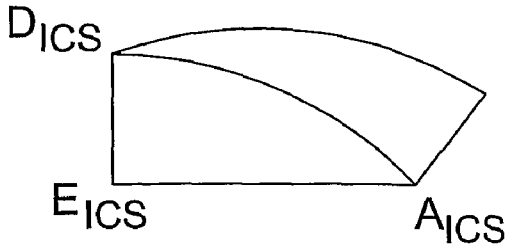

Similarly the curved ICS pieces described in FIGS. 31*a,b,c* and *d* have 5 surfaces, 4 of which are flat and one is curved. Sixty of the ICS pieces can be clad onto the outside of the icosahedron shown in FIG. 35 to form a sphere radius x.

Figure 32A:
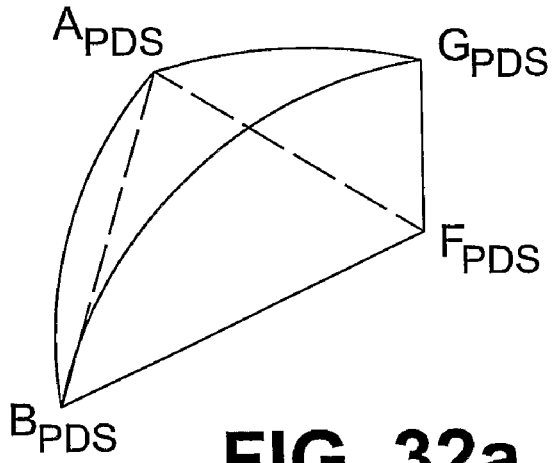
FIGS. 32 *a,b,c* and *d* illustrate one of the 60 identical curved PDS pieces used to convert a pentagonal dodecahedron shown in FIG. 36 into a sphere.
Figure 32B:
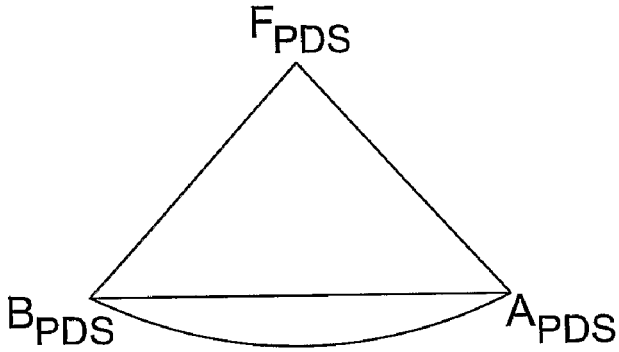
Figure 32C:
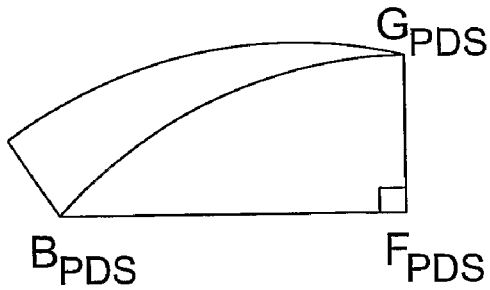
Figure 32D:
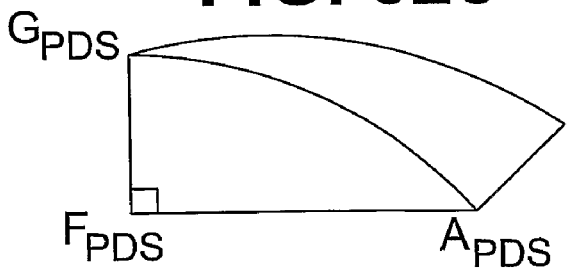

Similarly the curved PDS pieces described in FIGS. 32*a, b,c* and *d* have 5 surfaces, 4 of which are flat and one is curved. Sixty of the PDS pieces can be clad onto the pentagonal dodecahedron shown in FIG. 36 to form a sphere radius $x\sqrt{3}/\sqrt{2}$.

These ICS and PDS pieces are primarily useful for the kit with a large number of P and T pieces (120 P pieces and 120 T pieces) capable of building the icosahedron and the pentagonal dodecahedron.

It is clear that each kit in accordance with the teachings of this invention comprises various components that can be assembled into a multitude of shapes. Therefore, it could be difficult to a player to determine which puzzles (or shapes) are available in each kit. This can be especially daunting to a relatively new, inexperienced player.

Figure 27A:
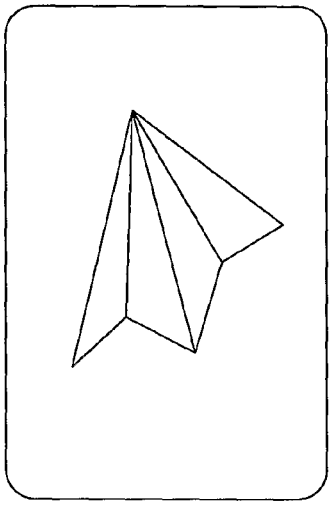
FIGS. 27*a* and 27*b* show an example of the front and back of the puzzle cards that may accompany a kit in one embodiment to illustrate a possible shape that can be assembled from the pieces of that kit.
Figure 27B:
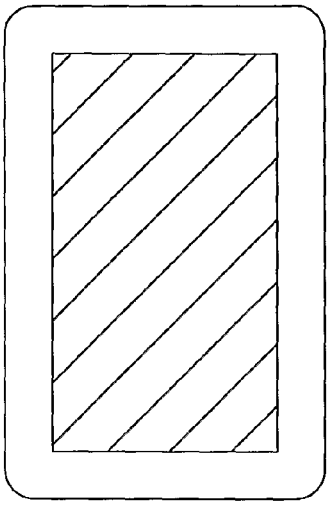

Accordingly, referring to FIGS. 27*a* and 27*b* in one embodiment, the invention then also provides a set of playing cards included with each kit, each card depicting an image of one shape than can be assembled from the components of the kit. The inclusion of these cards informs a player which shapes can be assembled with a particular kit.

For example with the starter kit of one rhombic hexahedron (FIGS. 25 and 26) made from 6 "P" and 6 "T" components suitable for beginners, there are at least thirteen shapes available for assembly from these 12 components. One such shape is a "tripod". With this kit then, there could be included a set of thirteen cards, each illustrating one shape that can be assembled, including the "tripod".

Figure 28A:
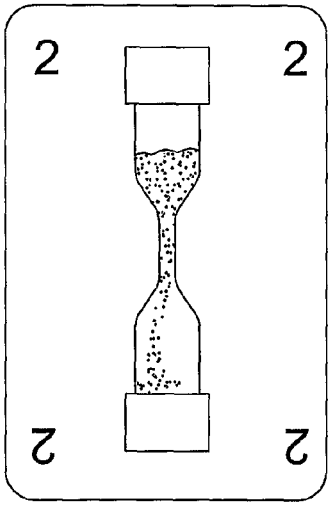
FIGS. 28*a, b* and *c* show the 2 minute, 4 minute and 6 minute timer cards that may accompany a kit in one embodiment.
Figure 28B:
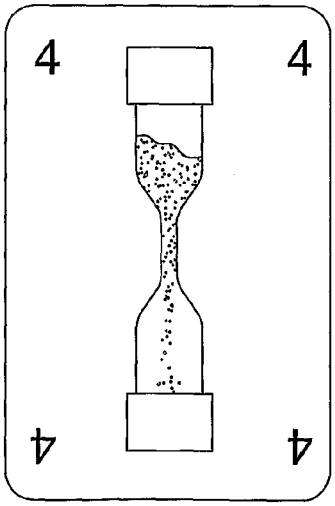
Figure 28C:
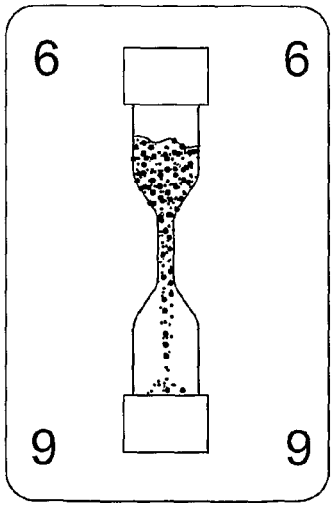

Referring to FIGS. 28*a*, 28*b* and 28*c* each kit may also include a timer or timers to provide an extra challenge to the player. Preferably, there are three time cards, each timer providing either in 2, 4 or 6 minutes. The player may choose one time card and attempt to solve the puzzle within the illustrated period of time.

The versatility and simplicity of these two particular "P" and "T" shapes when in multiple quantities is their remarkable attribute. The ability to construct a multitude of other interesting geometric shapes from just two basic pieces is what sets this invention apart from its predecessors.

The addition of curved pieces adds further to the number of constructions because one of the faces of the curved pieces matches one of the faces of the "P" and "T" components and therefore can be added by the player in any way that the faces match up. The formation of spheres using the various curved pieces is just one way the curved pieces can be used while playing with the toy.

Numerous modifications may be made without departing from the spirit and scope of the invention as defined in the appended claims.

The embodiments of the invention in which an exclusive property or privilege is claimed are defined as follows:

1. A geometric puzzle comprising:

twelve "P" type components being derived by notionally dividing a regular pyramid with a square base and having edges of equal length into twelve equal parts, each "P" type component having two faces that are right-angled triangles and two faces that are isosceles triangles; and twelve "T" type components being derived by notionally dividing a regular tetrahedron having edges of equal length into twelve equal parts, each "T" type component having two faces that are right-angled triangles and two faces that are isosceles triangles;

wherein:

one face of each "P" type component is identical to one face of each "T" type component;

each face of each component has magnets embedded therein to permit the components to be releasably mated to form composite shapes;

each isosceles triangle face of both the "P" type components and the "T" type components have two magnets being placed on either side of and equidistant from a line of symmetry from the vertex of each isosceles triangle;

each right-angled triangle face of each "P" type component has two magnets being placed on either side of and equidistant from a line 90 degrees from the midpoint of the hypotenuse of each right-angled triangle of each "P" type component;

each right-angled triangle face of each "T" type component has two magnets being placed on one side of a line 90 degrees through the midpoint of the second longest side of each "T" type component toward the right angle of the triangle; and the poles of each magnet being chosen such that:

identical faces of each "P" type component can releasably mate with one another;

identical faces of each "T" type component can releasably mate with one another;

the one face of the "P" type component that is identical to one face of a "T" type component can releasably mate with one another to form a space packer tetrahedron; and one isosceles triangle face of a first space packer tetrahedron and one isosceles triangle face of a second space packer tetrahedron can releasably mate to form a composite tetrahedron and another isosceles triangle face of the first space packer tetrahedron and another isosceles triangle face of the second space packer tetrahedron can releasably mate to form a mirror image of the composite tetrahedron; and wherein each of the twelve "P" type components and each of the twelve "T" type components can be assembled to form both a cube and a hexagon.

2. A geometric puzzle as claimed in claim 1, further comprising a set of cards, each illustrating one shape that can be assembled.

3. A geometric puzzle as claimed in claim 2, further comprising a timer providing either 2, 4 or 6 minutes.

4. A geometric puzzle as claimed in claim 1, further comprising pieces that are curved on at least one surface thereof such that each piece can be mounted to the assembled composite shape to convert the assembled composite shape into a sphere.

5. A geometric puzzle as claimed in claim 4, wherein each piece includes at least one face that is identical to at least one face of each component to permit the piece to be mounted to the assembled composite shape.

6. A geometric puzzle as claimed in claim 1, wherein at least one of the twelve components is further divided in half to form two components of mirror images.

7. A geometric puzzle as claimed in claim 1, wherein the twelve T type components each have six edges of the following relative lengths:

$$x, \frac{x}{\sqrt{3}}, \frac{x\sqrt{3}}{2\sqrt{2}}, \frac{x}{2\sqrt{6}}, \frac{x}{\sqrt{3}}, \frac{x\sqrt{3}}{2\sqrt{2}}.$$

8. A geometric puzzle as claimed in claim 1, wherein the twelve P type components each have six edges of the following relative lengths:

$$x, \frac{x}{\sqrt{3}}, \frac{x}{\sqrt{2}}, \frac{x}{\sqrt{6}}, \frac{x}{\sqrt{3}}, \frac{x}{\sqrt{2}}.$$

* * * * *